US005079598A

United States Patent [19]

Kaneko et al.

[11] Patent Number: 5,079,598

[45] Date of Patent: Jan. 7, 1992

[54] IMAGE FORMING APPARATUS THAT FEEDS A SPECIFIC SHEET AFTER A PREDETERMINED NUMBER OF IMAGES

[75] Inventors: Tokuharu Kaneko, Yokohama; Miho Nakayama, Tokyo; Masanori Miyata, Yokohama; Takeshi Honjo, Kawasaki; Hideki Adachi, Kawasaki; Toshiya Kanazawa, Kawasaki, all of Japan

[73] Assignee: Canon Kabushiki Kaisha, Tokyo, Japan

[21] Appl. No.: 321,840

[22] Filed: Mar. 10, 1989

[30] Foreign Application Priority Data

| | | | |
|---|---|---|---|
| Mar. 14, 1988 | [JP] | Japan | 63-059660 |
| Mar. 14, 1988 | [JP] | Japan | 63-059661 |
| Mar. 14, 1988 | [JP] | Japan | 63-059662 |
| Mar. 14, 1988 | [JP] | Japan | 63-059663 |
| Mar. 14, 1988 | [JP] | Japan | 63-059664 |
| Mar. 14, 1988 | [JP] | Japan | 63-059665 |

[51] Int. Cl.[5] ..... G03G 15/00

[52] U.S. Cl. ..... 355/309; 355/313

[58] Field of Search ..... 355/308, 309, 311, 313, 355/319, 320, 325

[56] References Cited

U.S. PATENT DOCUMENTS

| | | | |
|---|---|---|---|
| 4,330,197 | 5/1982 | Smith et al. | 355/319 |
| 4,494,861 | 1/1985 | Tachika et al. | 355/313 X |
| 4,536,078 | 8/1985 | Ziehm | 355/319 X |
| 4,640,607 | 2/1987 | Bray | 355/319 X |
| 4,712,908 | 12/1987 | Nakayama et al. | 355/243 |
| 4,763,161 | 8/1988 | Forest et al. | 355/325 X |

FOREIGN PATENT DOCUMENTS 57-191658 11/1982 Japan ..... 355/311

OTHER PUBLICATIONS

European Search Report dated Jun. 14, 1989.

*Primary Examiner*—Joan H. Pendegrass

*Attorney, Agent, or Firm*—Fitzpatrick, Cella, Harper & Scinto

[57] ABSTRACT

An image forming apparatus includes: an original circulation unit for feeding originals placed on an original mounting unit one by one to an exposure site and after the exposure, returning the original to the original mounting unit; a copying unit for copying an original image to a recording sheet through exposure of the original at the exposure site; a first transport unit for feeding the recording sheet to a copy site; a first control unit for performing the original circulation by the original circulation unit for a set number of times to obtain the set number of copies; a second transport unit for feeding a specific sheet for each circulation of the originals; and a second control unit for controlling the first and second transport units to pre-feed the recording sheet and the specific sheet to be next supplied during a copy operation; wherein the second control unit does not perform the pre-feed of the recording sheet and the specific sheet during the first circulation of the originals by the original circulation unit, performs the pre-feed of the recording sheet and controls the first and second transport units to pre-feed the specific sheet, during a copy operation for the second and succeeding circulations of the originals.

13 Claims, 27 Drawing Sheets

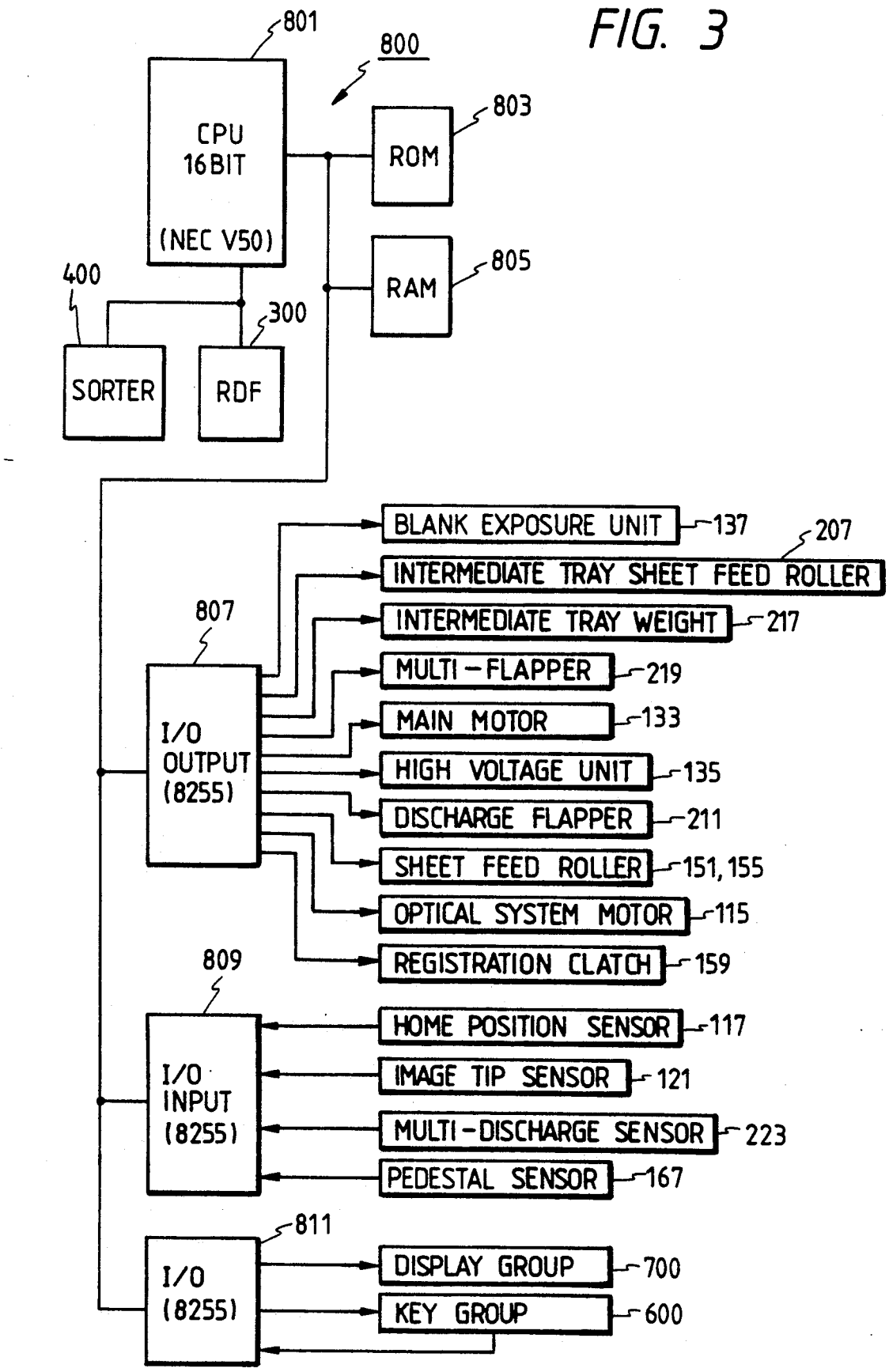
FIG. 3
801
800
CPU
16BIT
(NEC V50)
ROM
803
RAM
805
400
300
SORTER
RDF
BLANK EXPOSURE UNIT
137
207
INTERMEDIATE TRAY SHEET FEED ROLLER
807
INTERMEDIATE TRAY WEIGHT
217
MULTI-FLAPPER
219
MAIN MOTOR
133
I/O
OUTPUT
(8255)
HIGH VOLTAGE UNIT
135
DISCHARGE FLAPPER
211
SHEET FEED ROLLER
151, 155
OPTICAL SYSTEM MOTOR
115
REGISTRATION CLATCH
159
809
HOME POSITION SENSOR
117
I/O
INPUT
(8255)
IMAGE TIP SENSOR
121
MULTI-DISCHARGE SENSOR
223
PEDESTAL SENSOR
167
811
I/O
(8255)
DISPLAY GROUP
700
KEY GROUP
600

| FIG. 7A | FIG. 7B |
|---|---|

| FIG. 15A |
| --- |
| FIG. 15B |

IMAGE FORMING APPARATUS THAT FEEDS A SPECIFIC SHEET AFTER A PREDETERMINED NUMBER OF IMAGES

BACKGROUND OF THE INVENTION

The present invention relates to an image forming apparatus having a function to feed a specific sheet each time a predetermined number of images are formed.

An image forming apparatus has been proposed heretofore which apparatus is capable of operating at a mode (hereinafter called a cover mode) where a specific sheet with or without an image copied thereon is inserted as the cover for a certain number of originals or for a unit number of originals. This mode is a mode during which a different color sheet is inserted as a cover, or a separation sheet is inserted for an optional number of originals.

Also known is an automatic document feeder for an image forming apparatus which is capable of operating at a mode (hereinafter called an APS mode) where an original size is detected through preliminary scan of an original, and a cassette of a suitable sheet size is automatically selected based on the detected original size information and a copy magnification factor.

When the cover mode and the APS mode are both employed in the apparatus operation, if the cassette selected as suitable size during the APS mode is the specific cassette for the cover mode, then a sheet feed is carried out from the cover mode specific cassette contrary to the intention of an operator. Also, in the operation using both the cover mode and the APS mode, if the sheet size of the cassette selected as suitable during the APS mode differs from the size of a cover sheet in the specific cassette, then there occurs the problem that the finished set of the cover and copied originals has different sizes for the cover and the copied originals.

There is also known an image forming apparatus capable of operating at a mode (hereinafter called an ACC mode) where if all transfer sheets within the presently selected cassette have been consumed during the copy operation, a cassette having sheets of the same size is checked, and if present, the sheet feed cassette is automatically changed to that cassette.

If both the cover mode and the ACC mode are employed and when all transfer sheets within the cassette have been consumed, automatic cassette change function is actuated to select a cassette of the same sheet size, if any, to thereby continue the copy operation. However, if the selected cassette is the specific cassette for the cover mode, there occurs the problem that the operation not intended by the operator will be carried out.

Also generally known is a copying apparatus capable of copying a one side original onto the both sides of a recording member or sheet. If the both sides copy operation is carried out using one side originals including a cover original and if the number of originals is even, then the back side of the cover is also copied.

An apparatus has also been proposed which is provided with a plurality of color developing units and can form images by selecting a color used during the operation of forming a set of images. However, color cannot be changed on the way of forming a set of images.

Therefore, even if the cover mode function is provided for such an image forming apparatus, the cover is copied with the same color as the other originals. If the cover is to be copied with a different color, then an additional copy operation for that purpose only must be conducted, causing inconvenience for an operator.

Also known is an apparatus composed of a copying apparatus and a recycle type original document feeder (hereinafter called an RDF) which feeds documents placed on a tray one by one to the exposure site and after the exposure, returns a document to the same tray.

In performing a copy operation during the cover mode by using such an apparatus with RDF, even if a sheet different from an ordinary recording sheet is intended to be used as the cover corresponding to the first page original, this first page original cannot be discriminated as to the timing when it comes. Therefore, whether a recording sheet or a cover sheet is fed cannot be determined until the sheet feeding of the originals excluding the cover original has been completed. Such arrangement increases the time required for the sheet feeding, resulting in a large time for forming a set of copies and in lowering the production efficiency.

SUMMARY OF THE INVENTION

The present invention has been made in consideration of above problems. It is therefore an object of the present invention to provide an improved image forming apparatus.

It is another object of the present invention to provide an image forming apparatus capable of improving the production efficiency during the cover mode operation.

It is a further object of the present invention to provide an image forming apparatus capable of preventing erroneous operation during the cover mode operation.

It is a still further object of the present invention to provide an image forming apparatus capable of performing a switch operation to suitable sheet accommodating means even if the cover mode is selected.

It is another object of the present invention to provide an image forming apparatus capable of performing a switch operation to suitable sheet accommodating means even if both the cover mode and APS mode are selected.

It is a further object of the present invention to provide an image forming apparatus capable of preventing forming an improper set of copies even when both the cover mode and APS mode are selected.

It is a still further object of the present invention to provide an image forming apparatus capable of inserting a cover sheet or a separation sheer reliably even if originals are automatically fed for copying.

It is another object of the present invention to provide an image forming apparatus capable of obtaining two sides copies having a suitable cover from one sided originals.

It is a further objects of the present invention to provide an image forming apparatus capable of forming a different color cover without giving any inconvenience to an operator during such operation.

In one aspect of the invention, there is provided an image forming apparatus of the type which contains an original circulation means for feeding originals that have been placed on an original mounting unit. One by one the originals are circulated to an exposure site where they are exposed for copying to a recording sheet and then returned to the original mounting unit. There is a first transport means for feeding that recording sheet to the copy site and a first control means for controlling circulation of the originals so that each circulates the selected number of times. A second transport means is provided for feeding a specific sheet for each circulation of the originals. Thereafter, a second control means is provided to control the first and second transport means so as to pre-feed the recording sheet and the specific sheet to be next supplied during a copy operation, wherein the second control means does not perform the pre-feed of the recording sheet and specific sheet during the first circulation of the originals, but performs the pre-feed of the recording sheet and controls the first and second transport means to prefeed the specific sheet during a copy operation for the second and succeeding circulations of the originals.

The above and other objects will become apparent from the following detailed description when read in conjunction with the accompanying drawings.

BRIEF DESCRIPTION OF THE ACCOMPANYING DRAWINGS

FIG. 3 is a block diagram showing the circuit of the control unit of the image forming apparatus;

Figures 7, 7A:
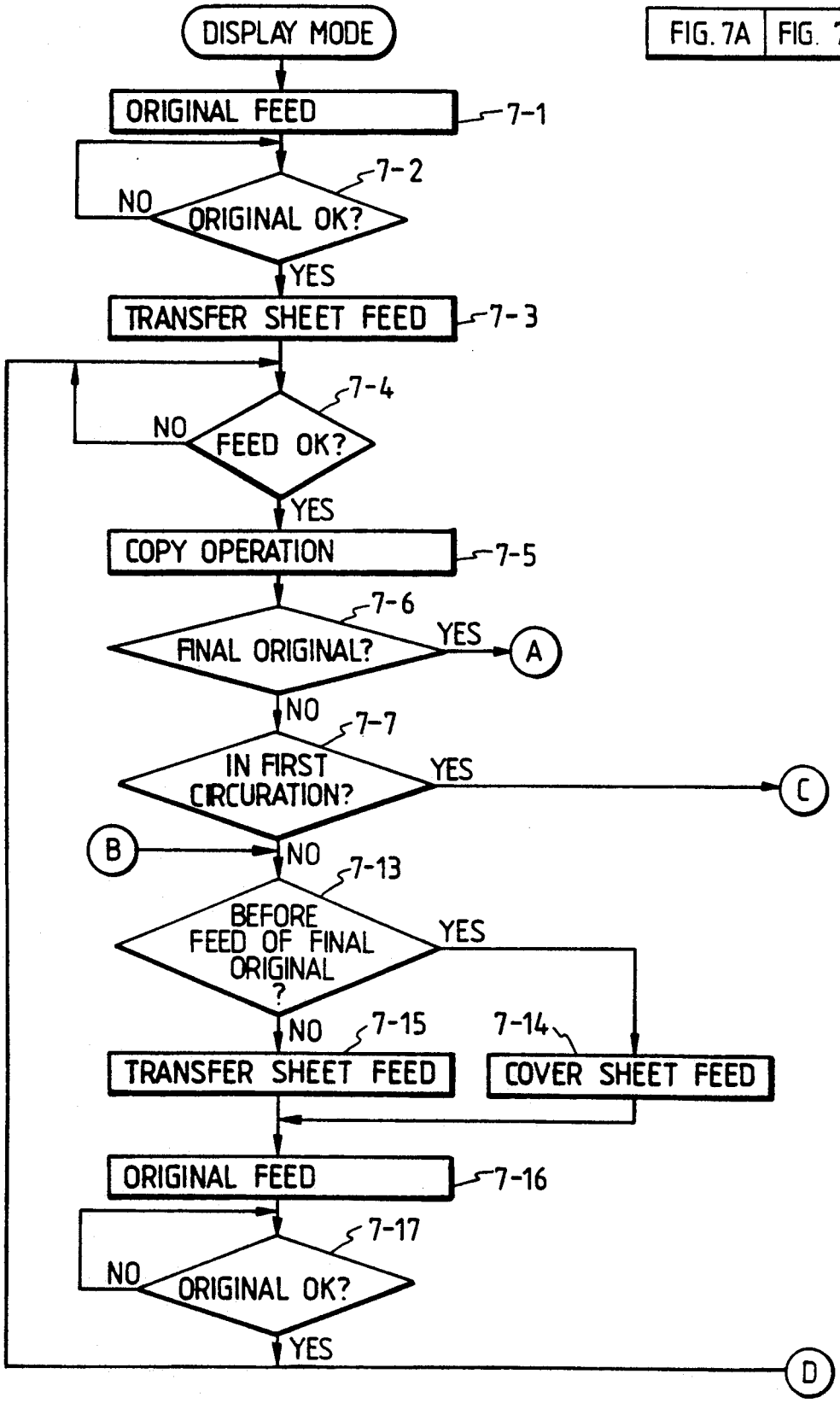
Figure 7B:
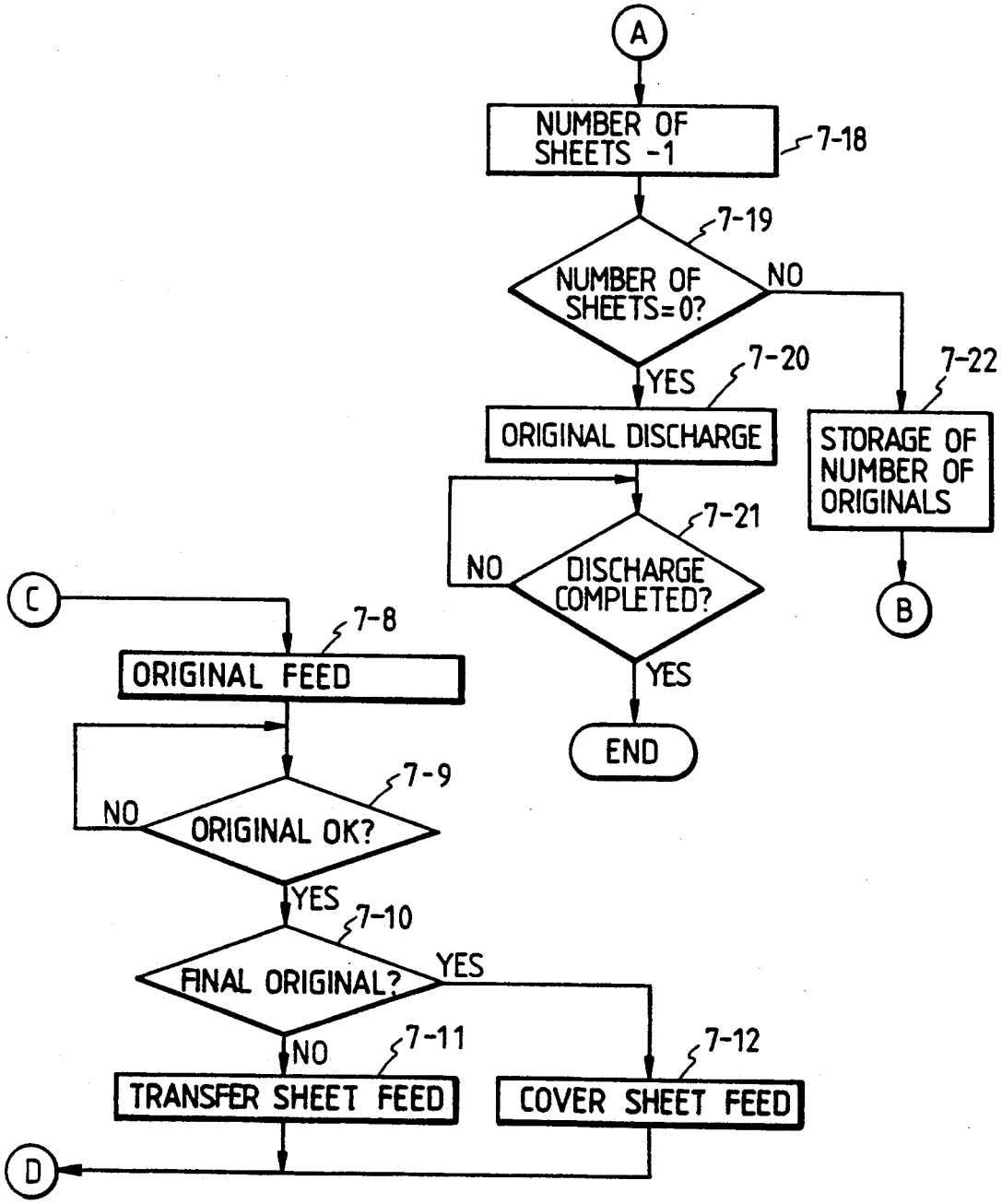
Figure 8:
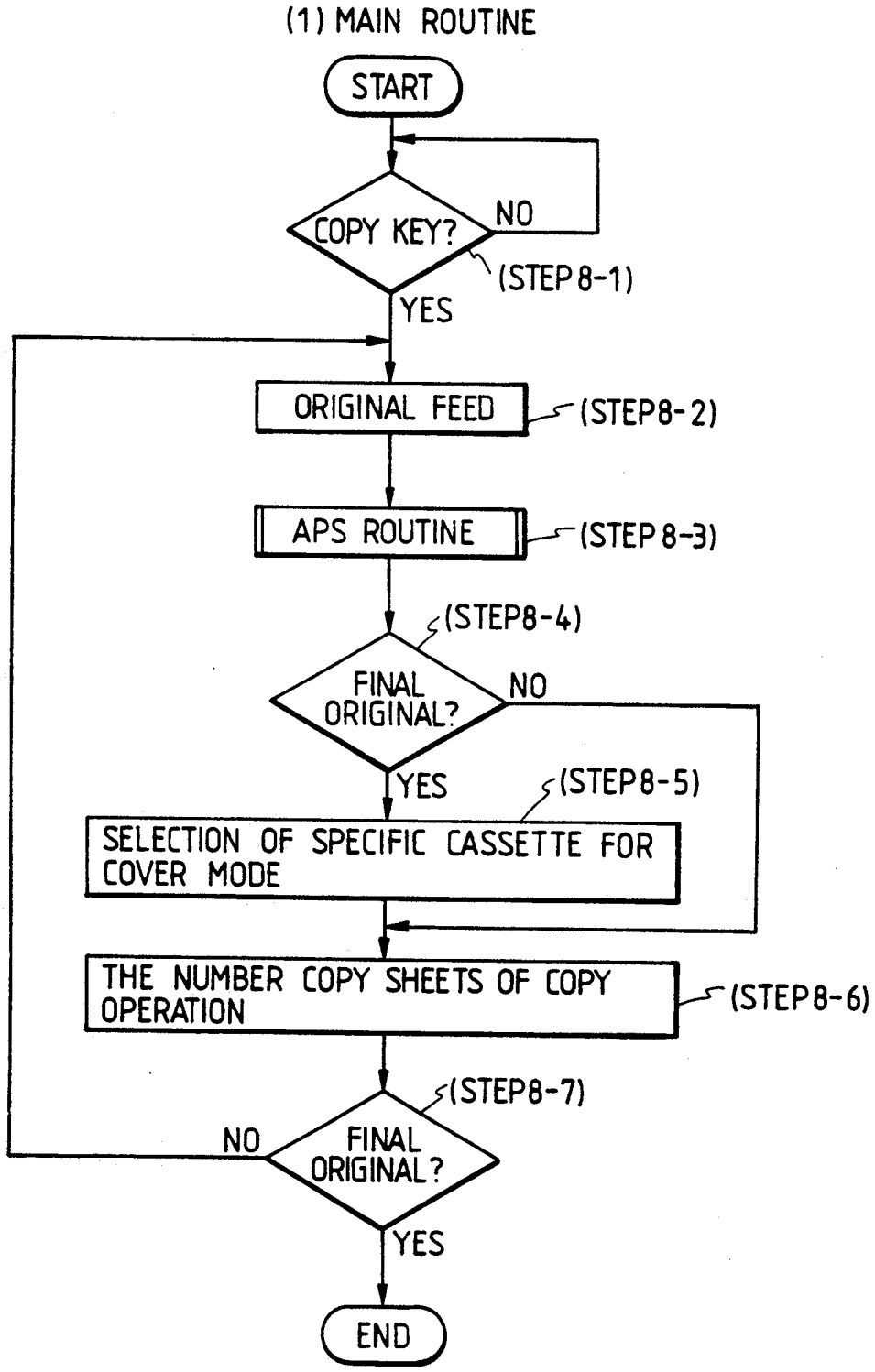
Figure 9:
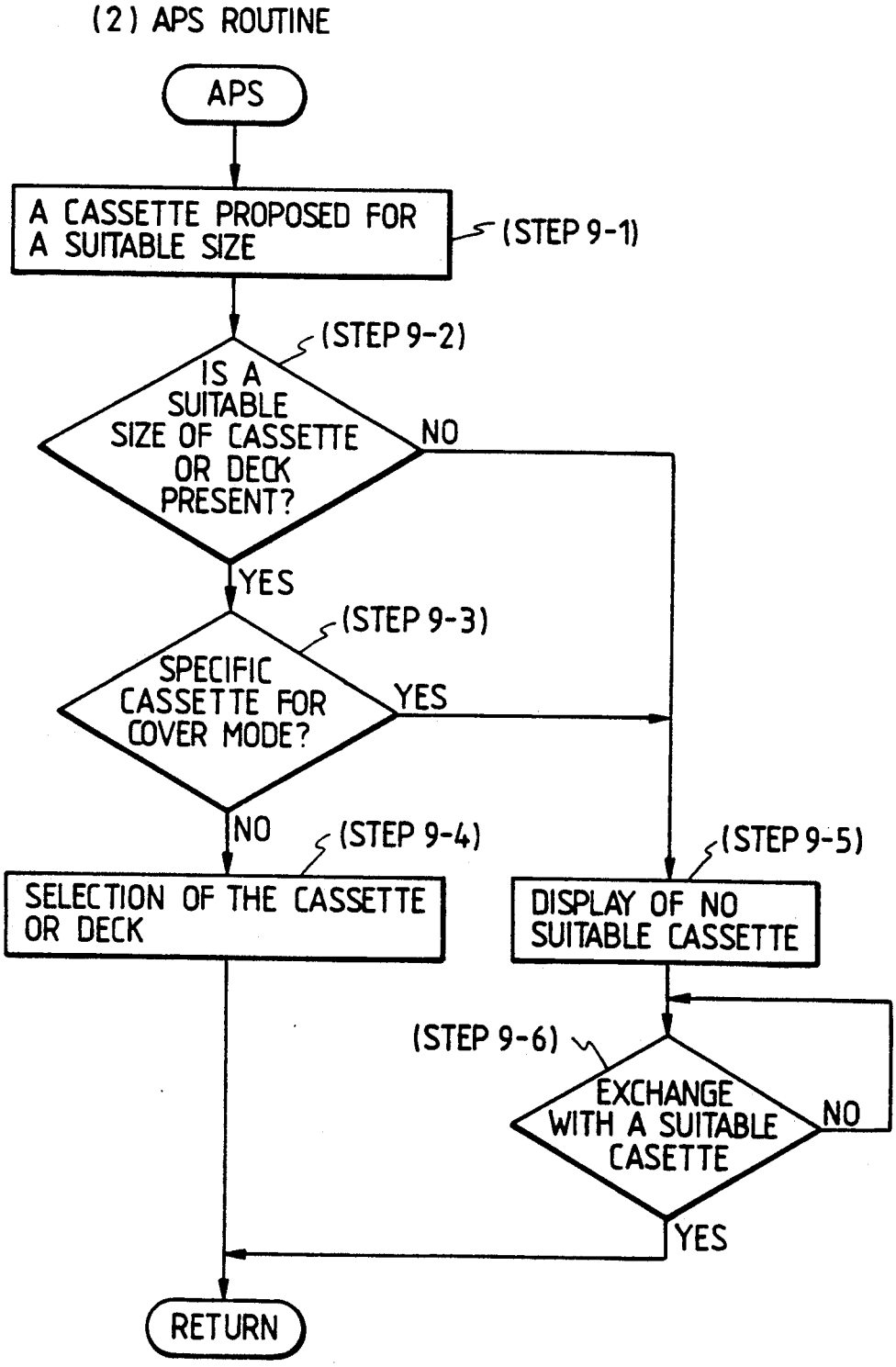
Figure 10:
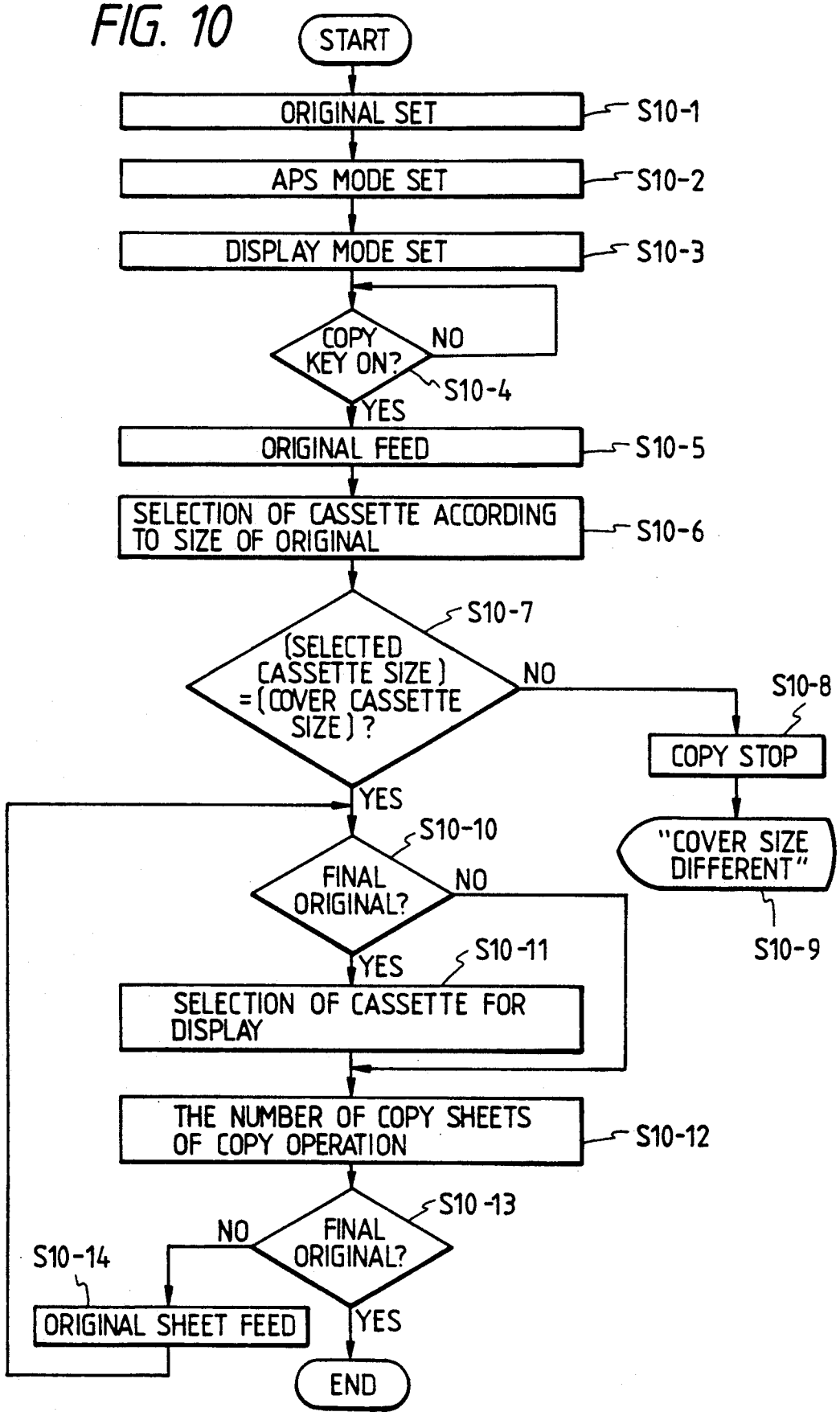
Figure 11:
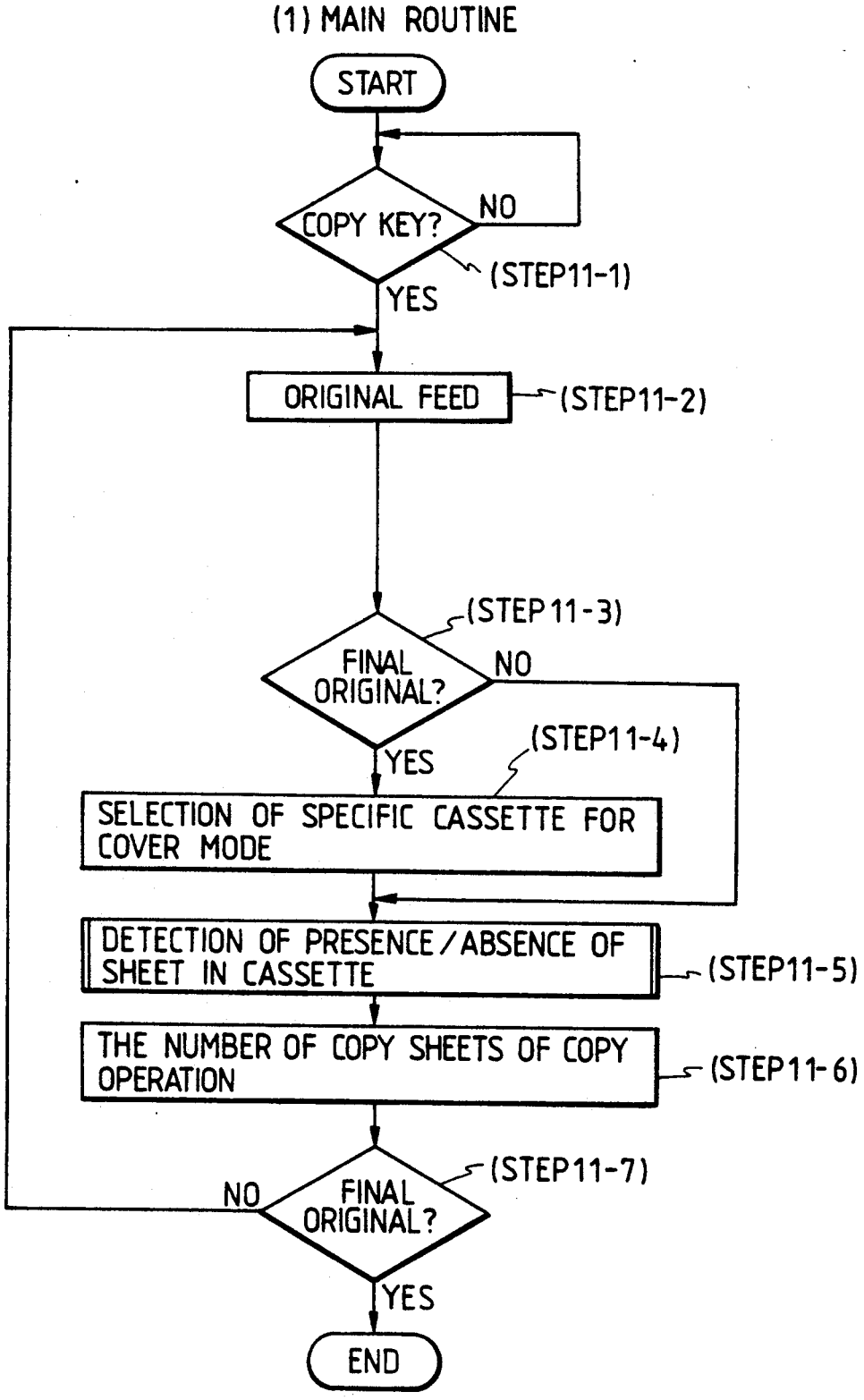
Figure 12:
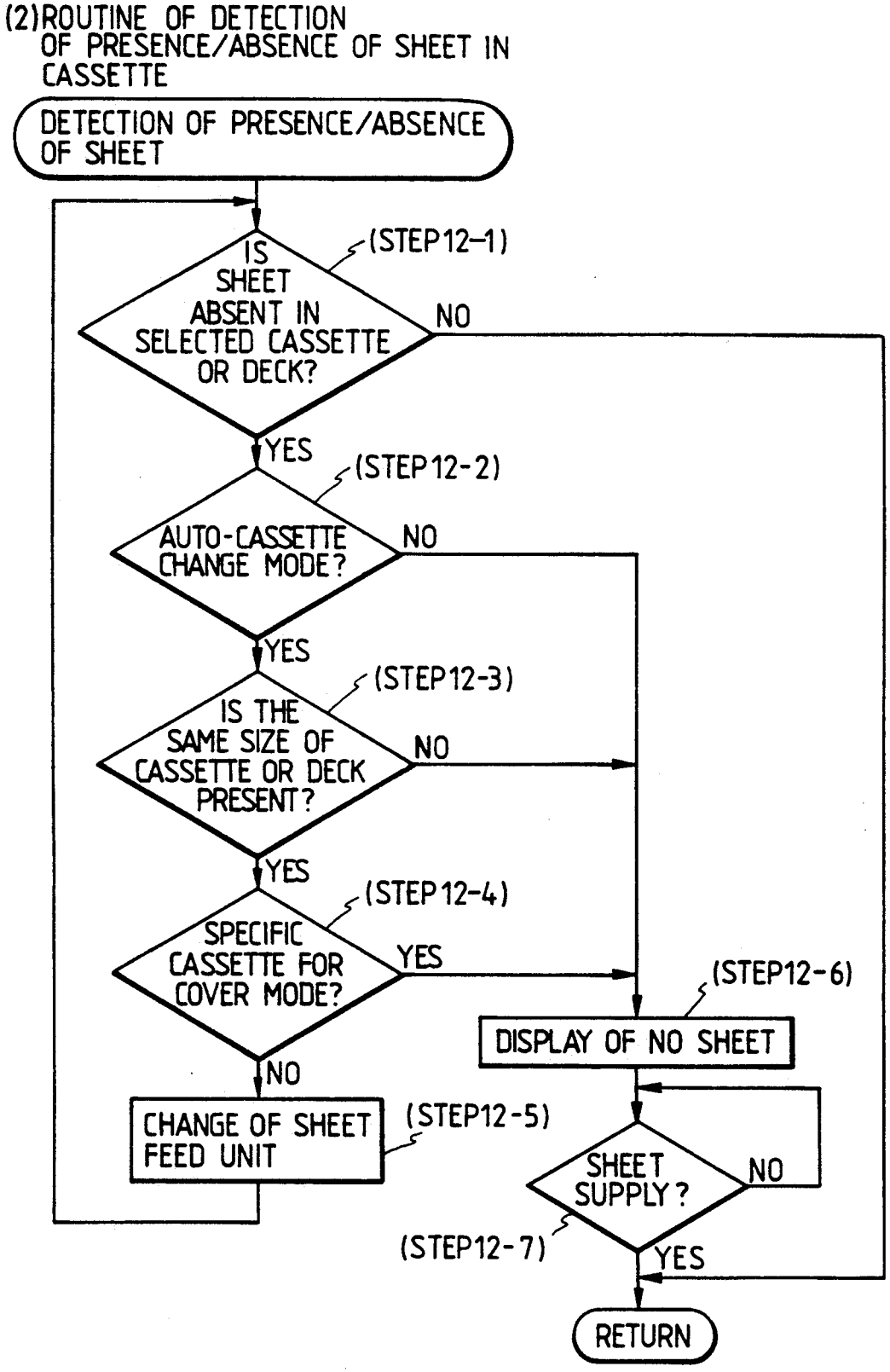
Figure 13:
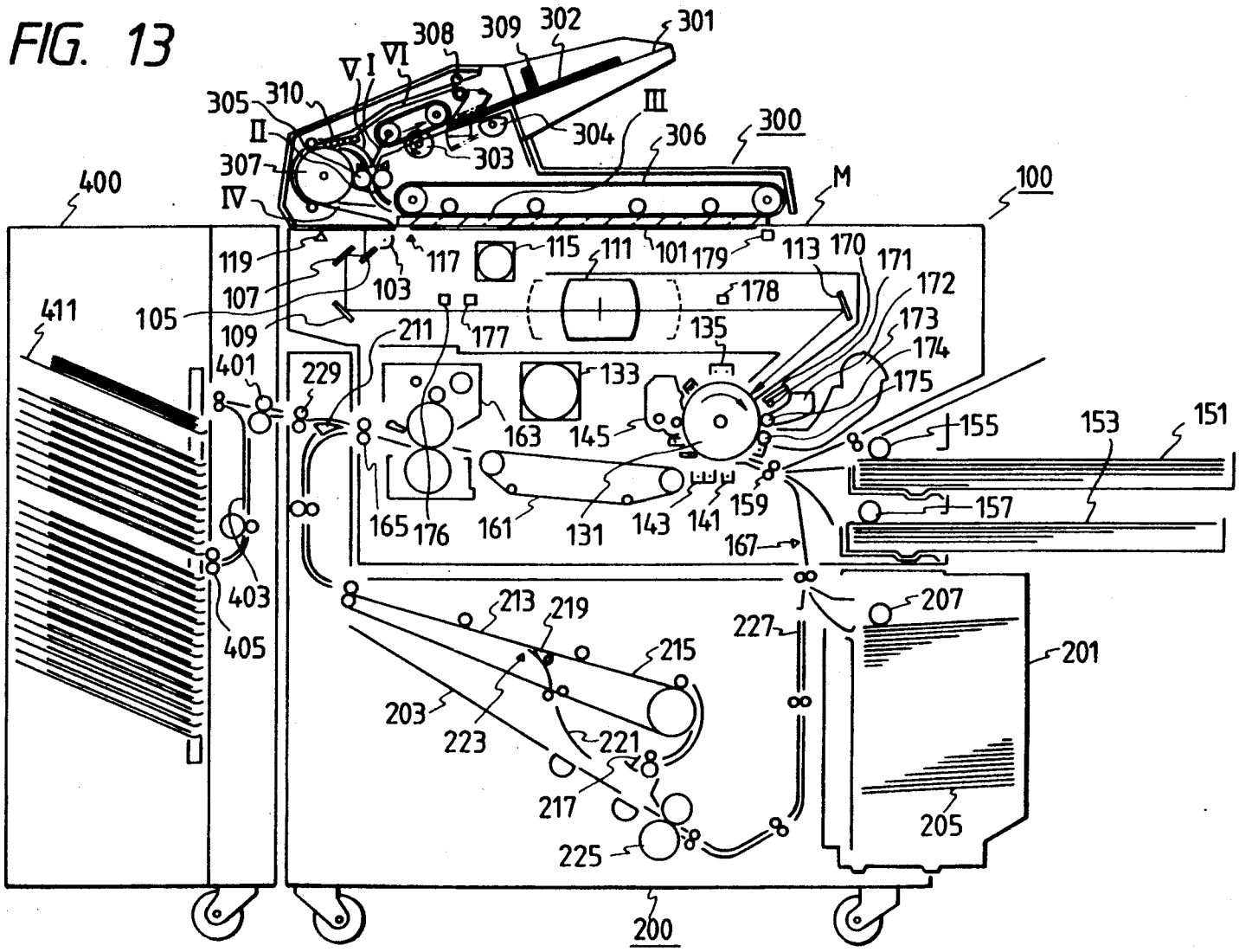
Figure 14:
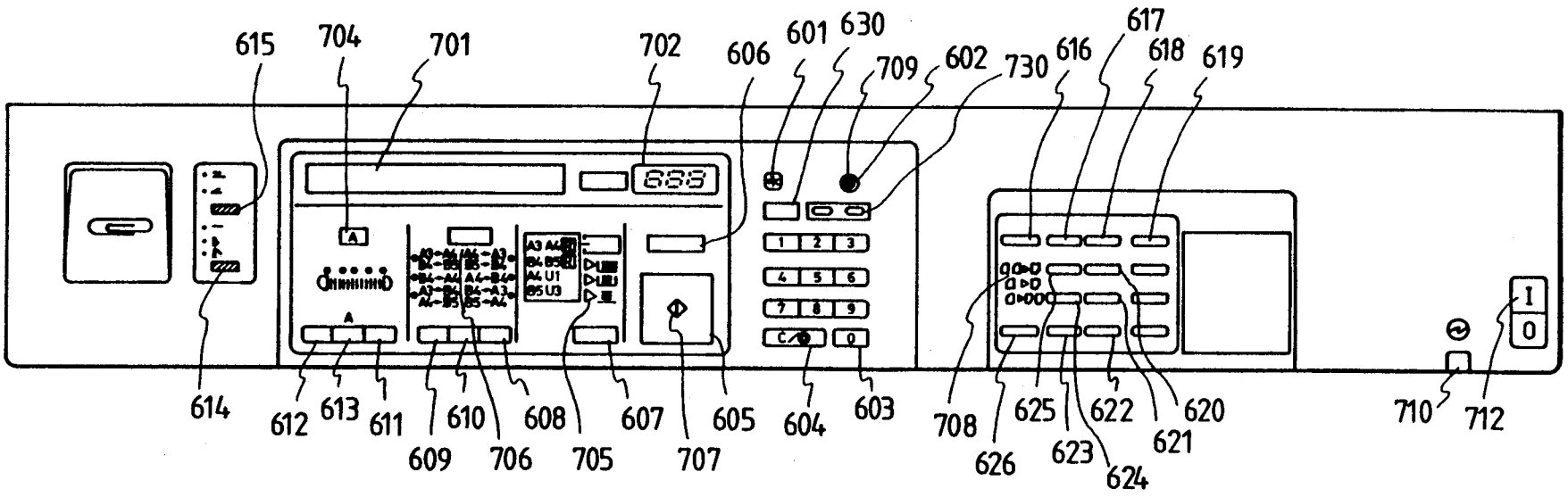
Figures 15, 15A:
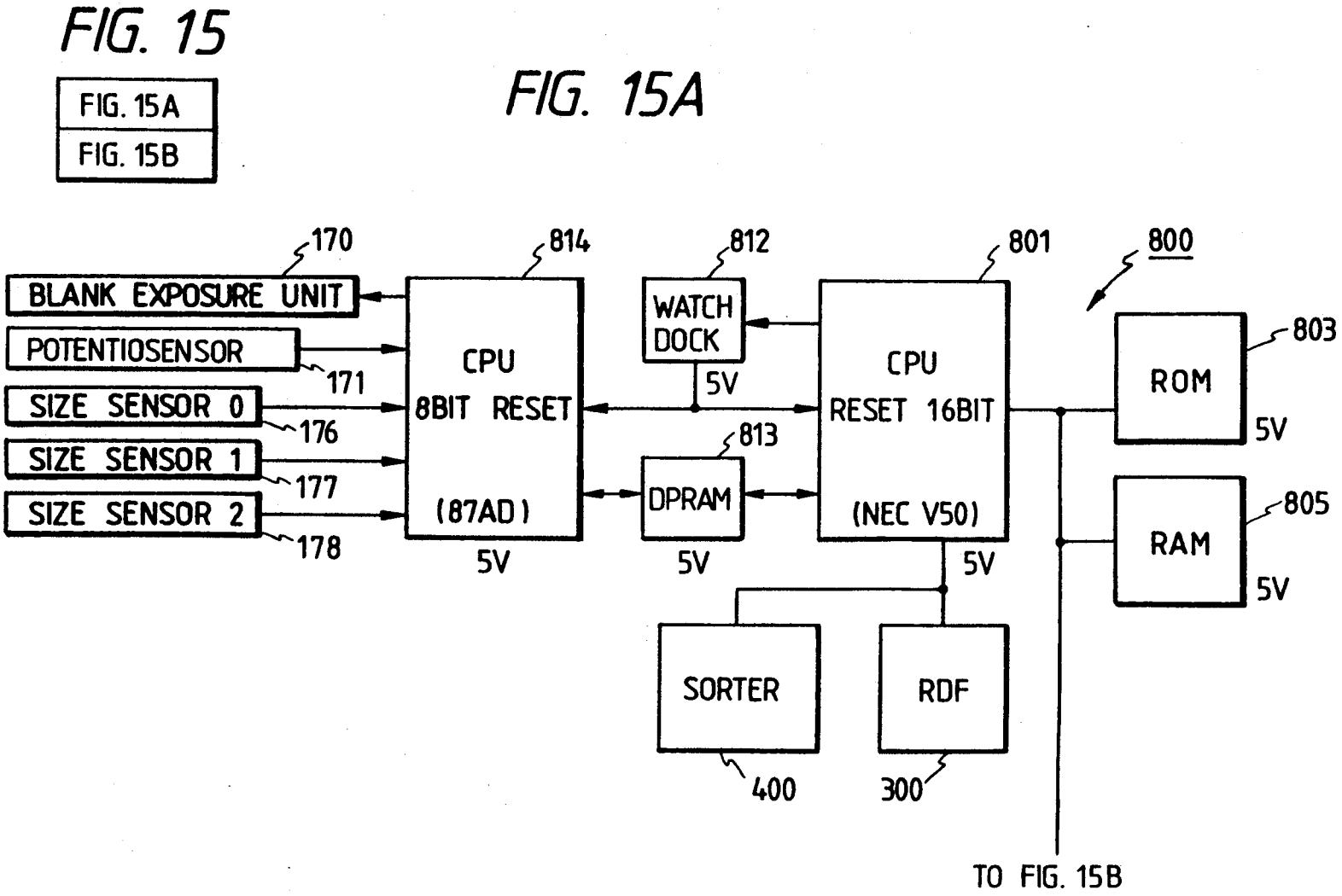
Figure 15B:
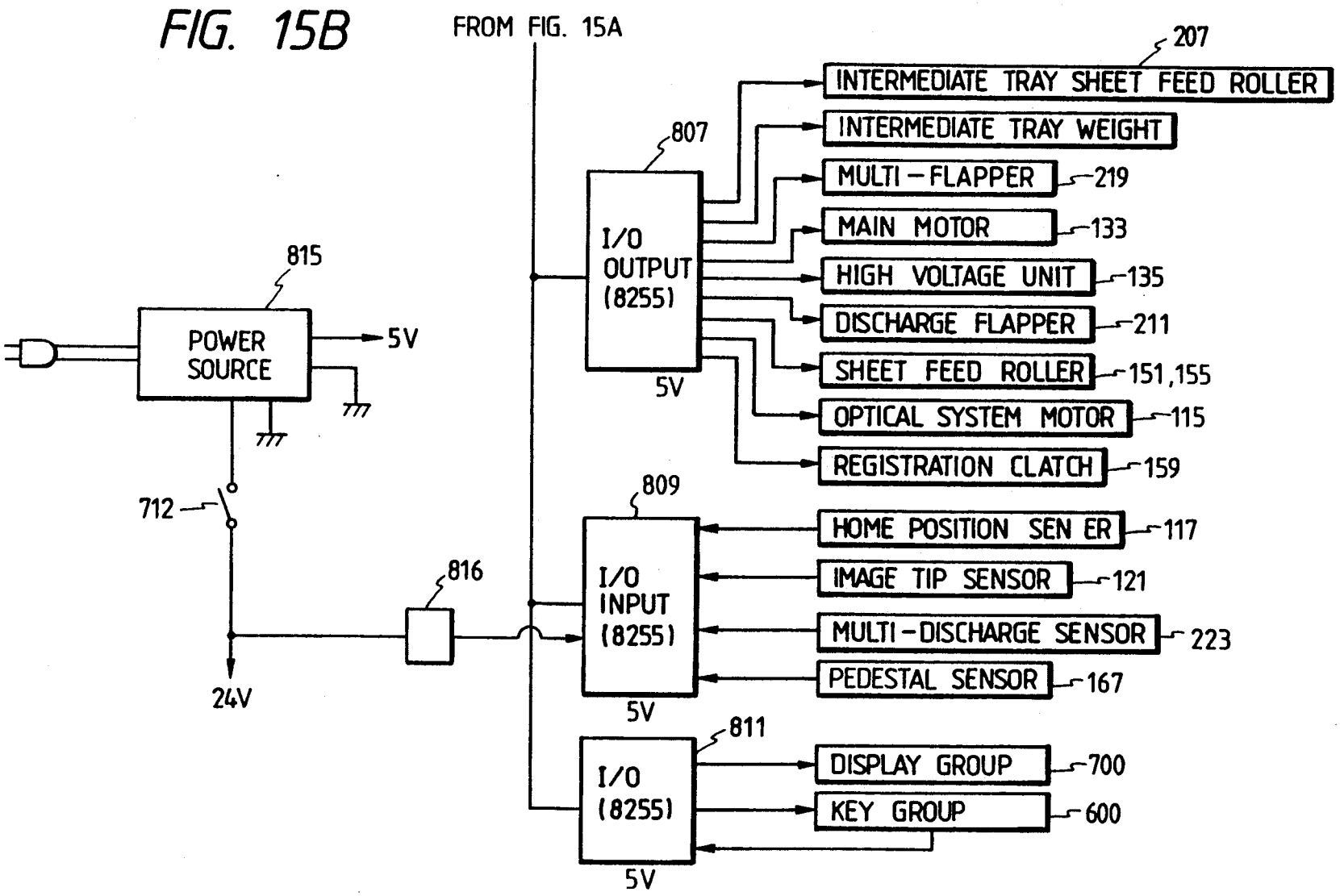
Figure 16:
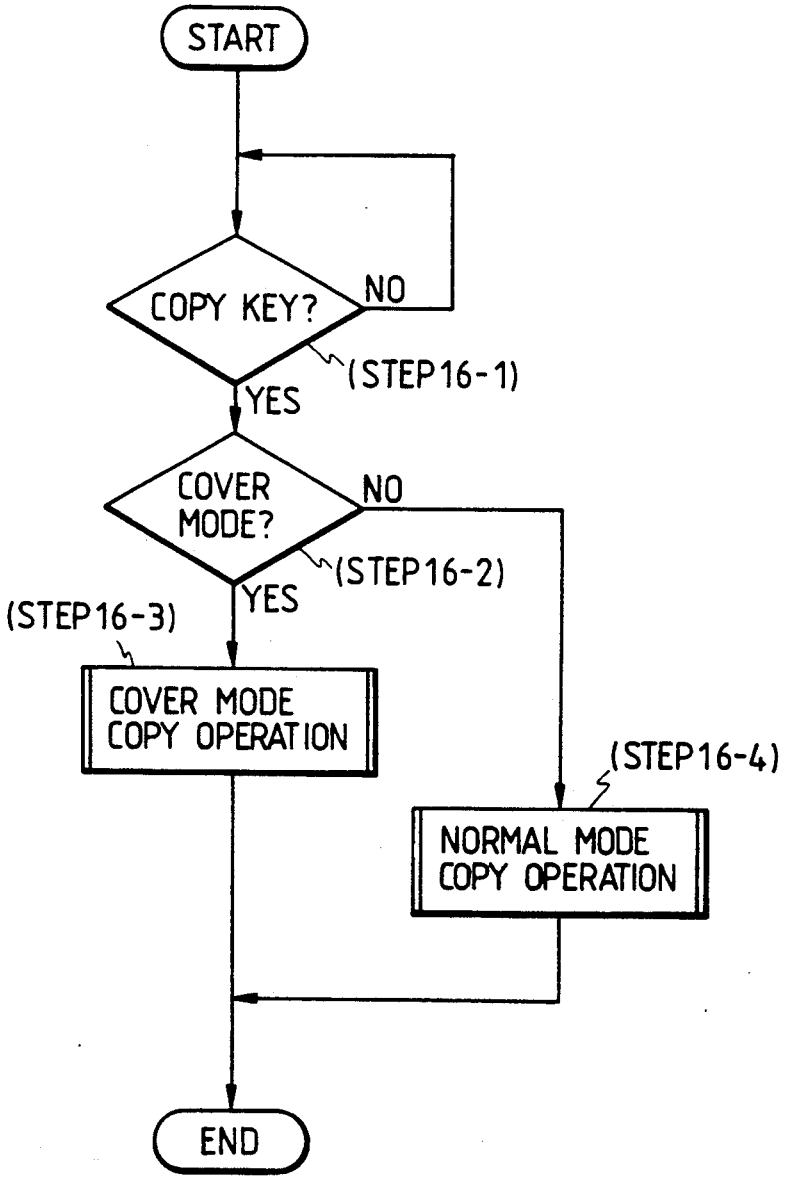
Figure 17:
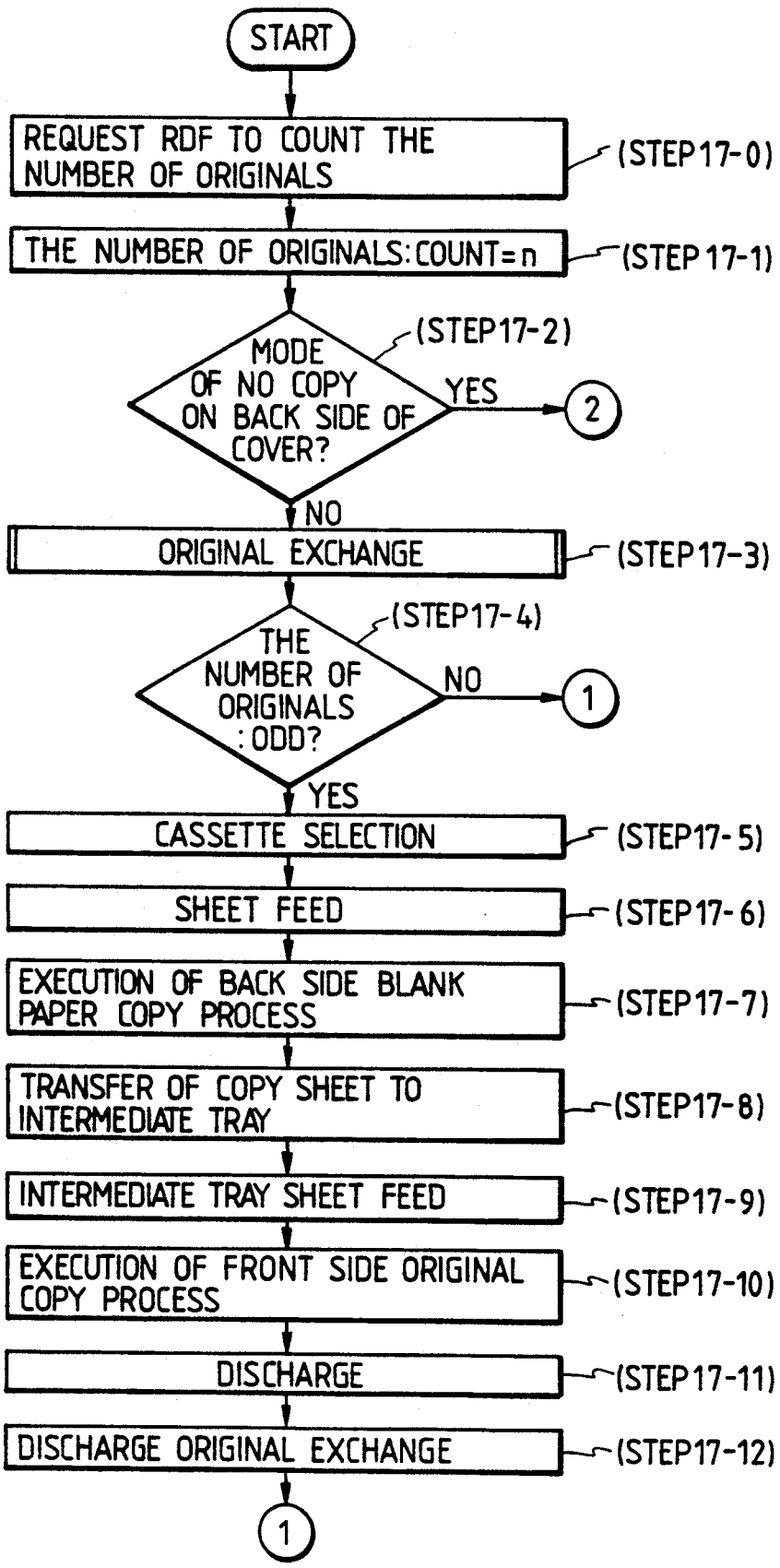
Figure 18:
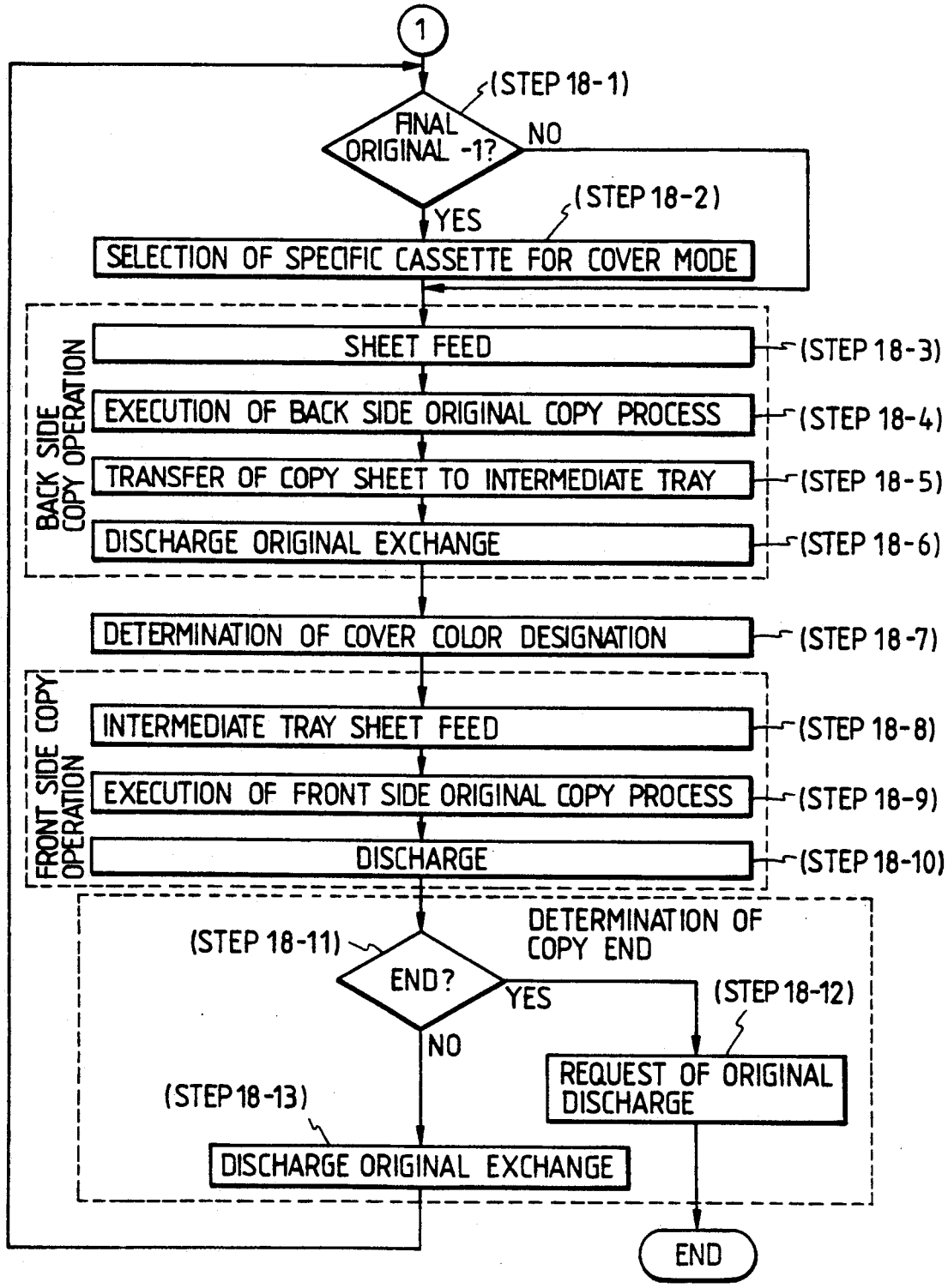
Figure 19:
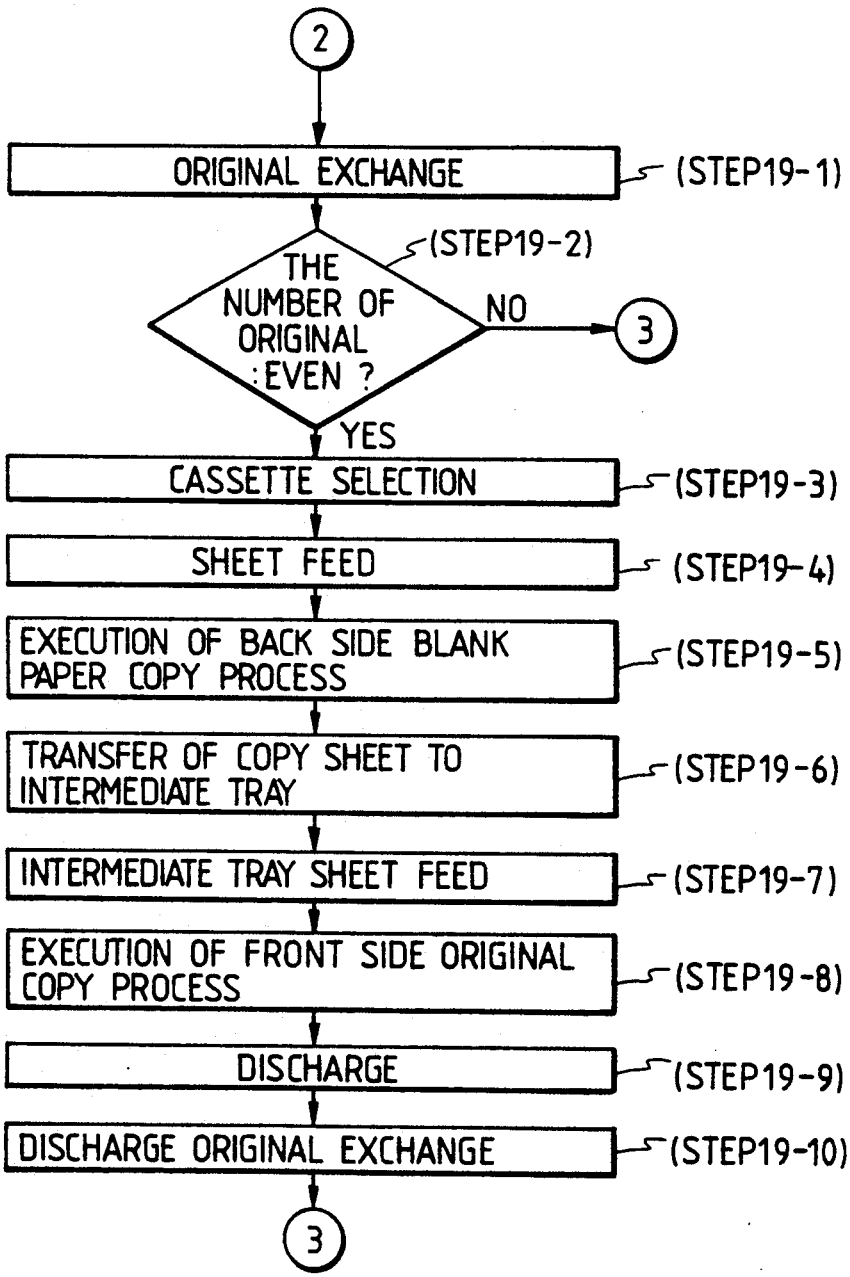
Figure 20:
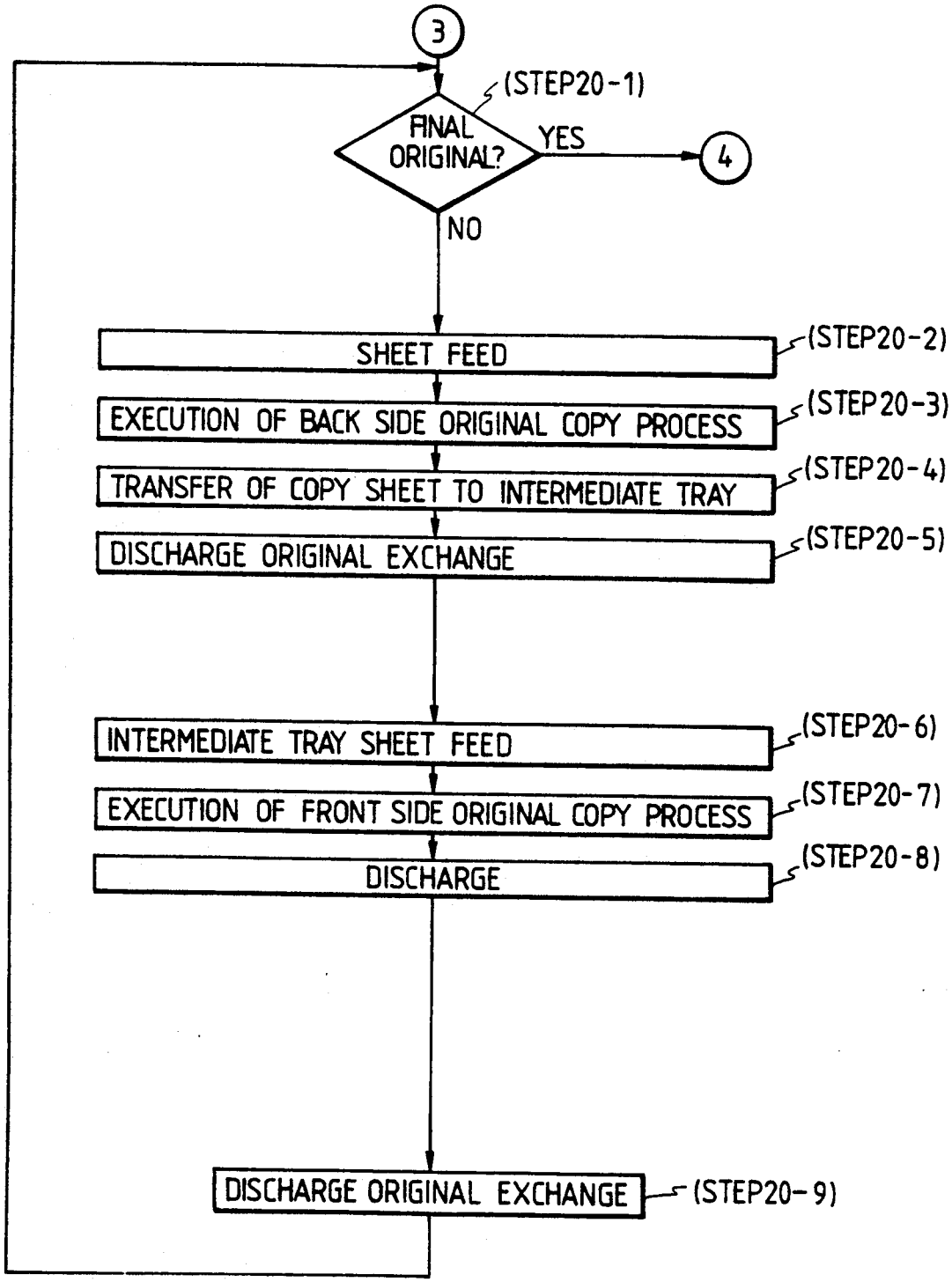
Figure 21:
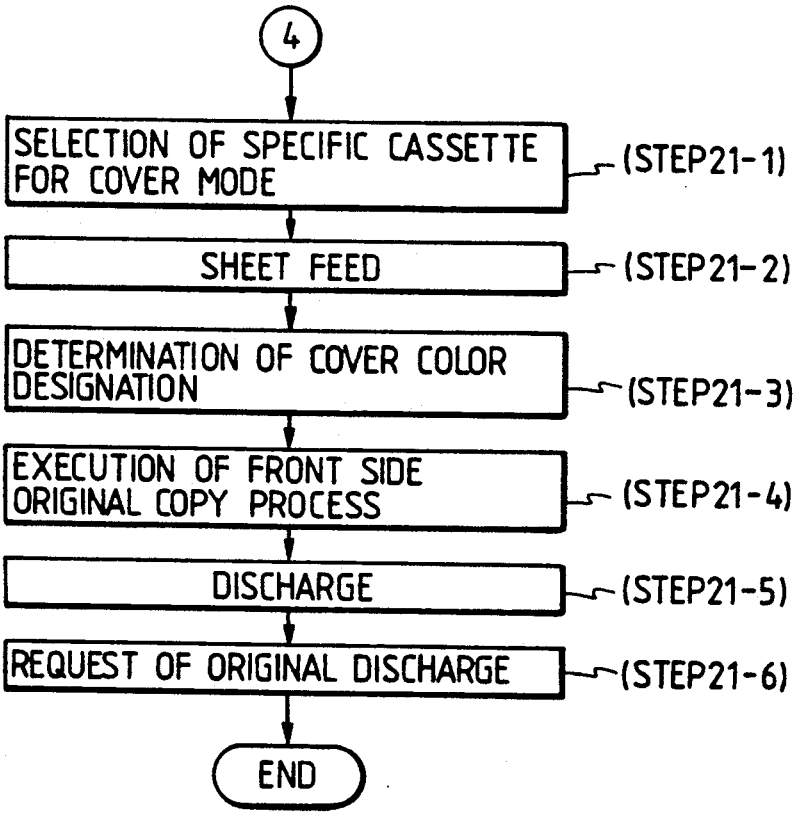
Figure 25:
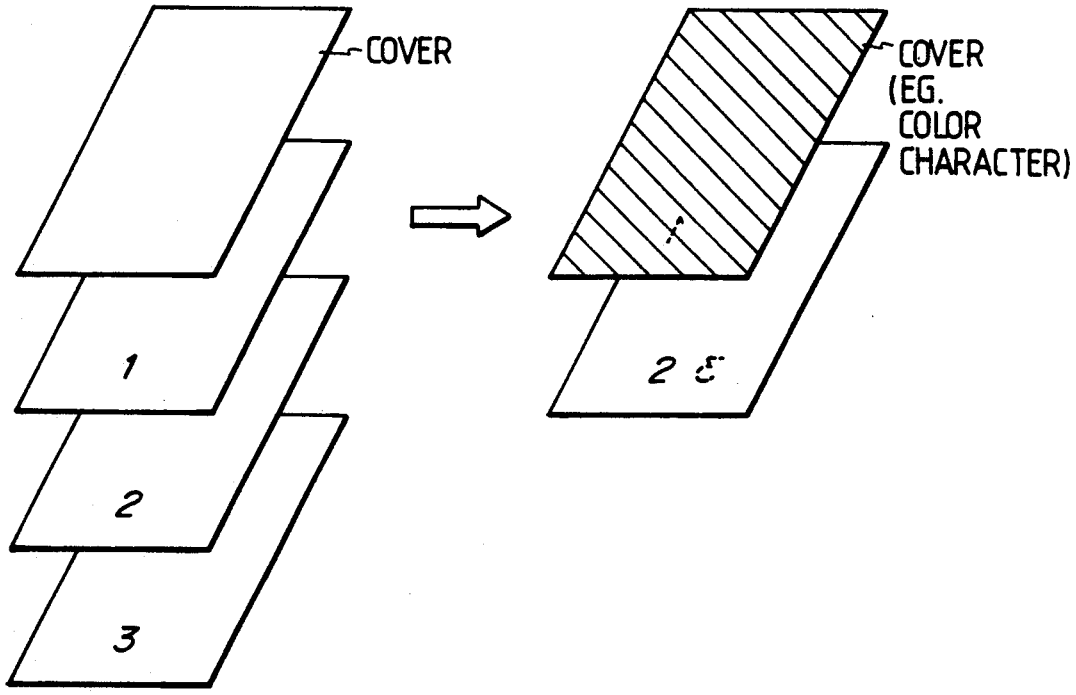
Figure 26:
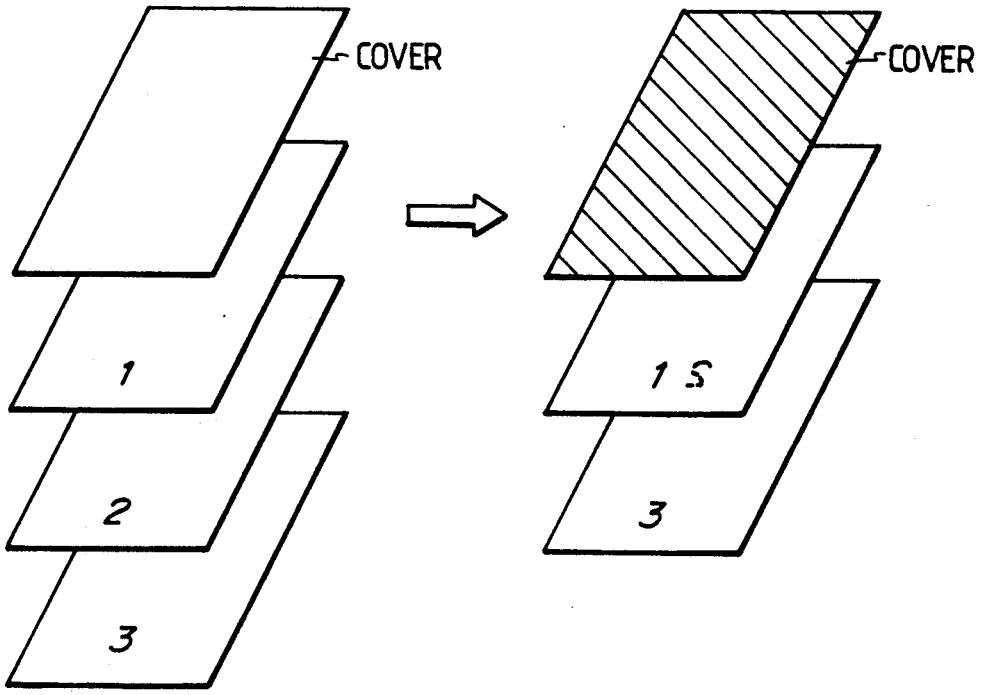
Figure 27:
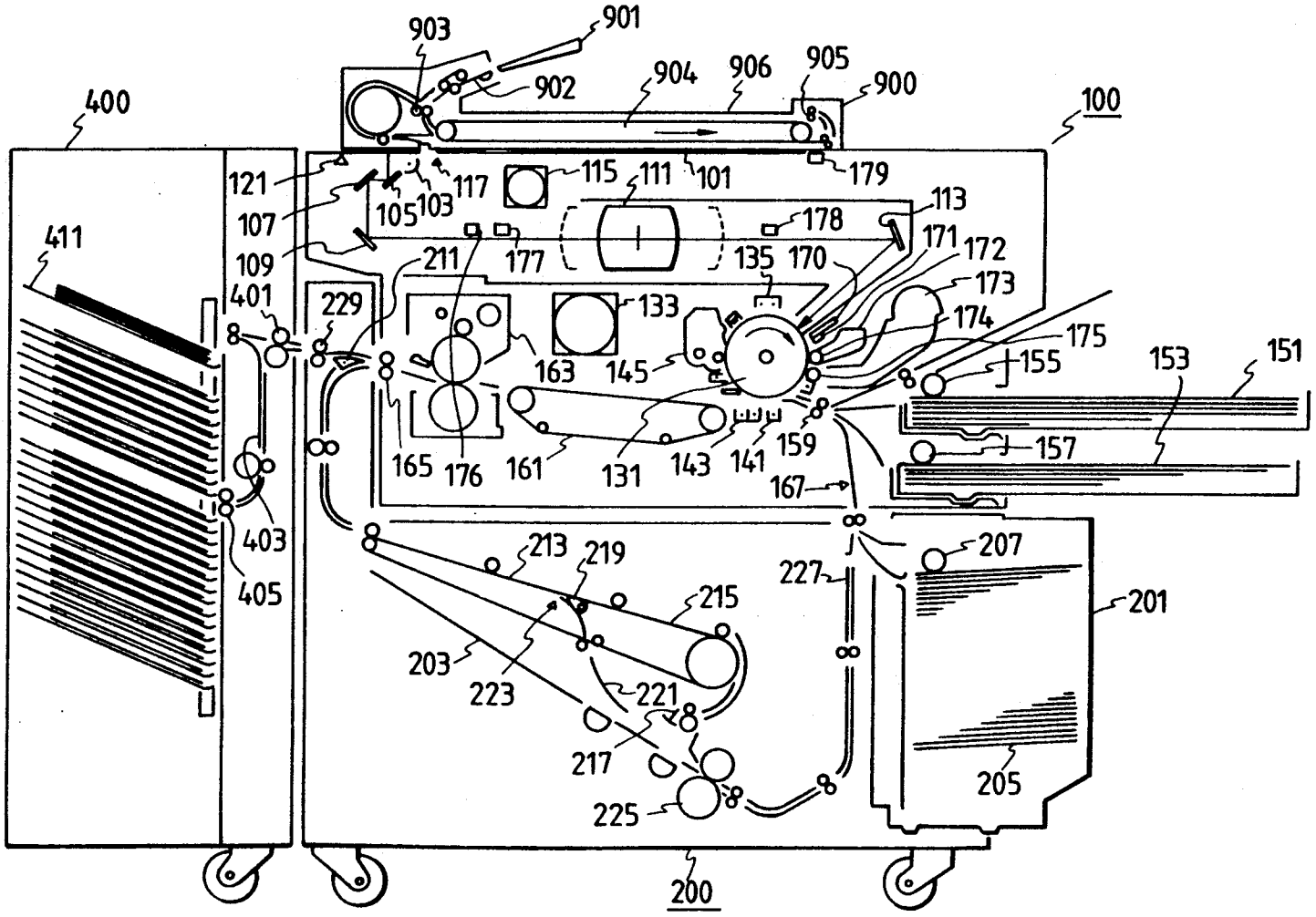
Figure 28:
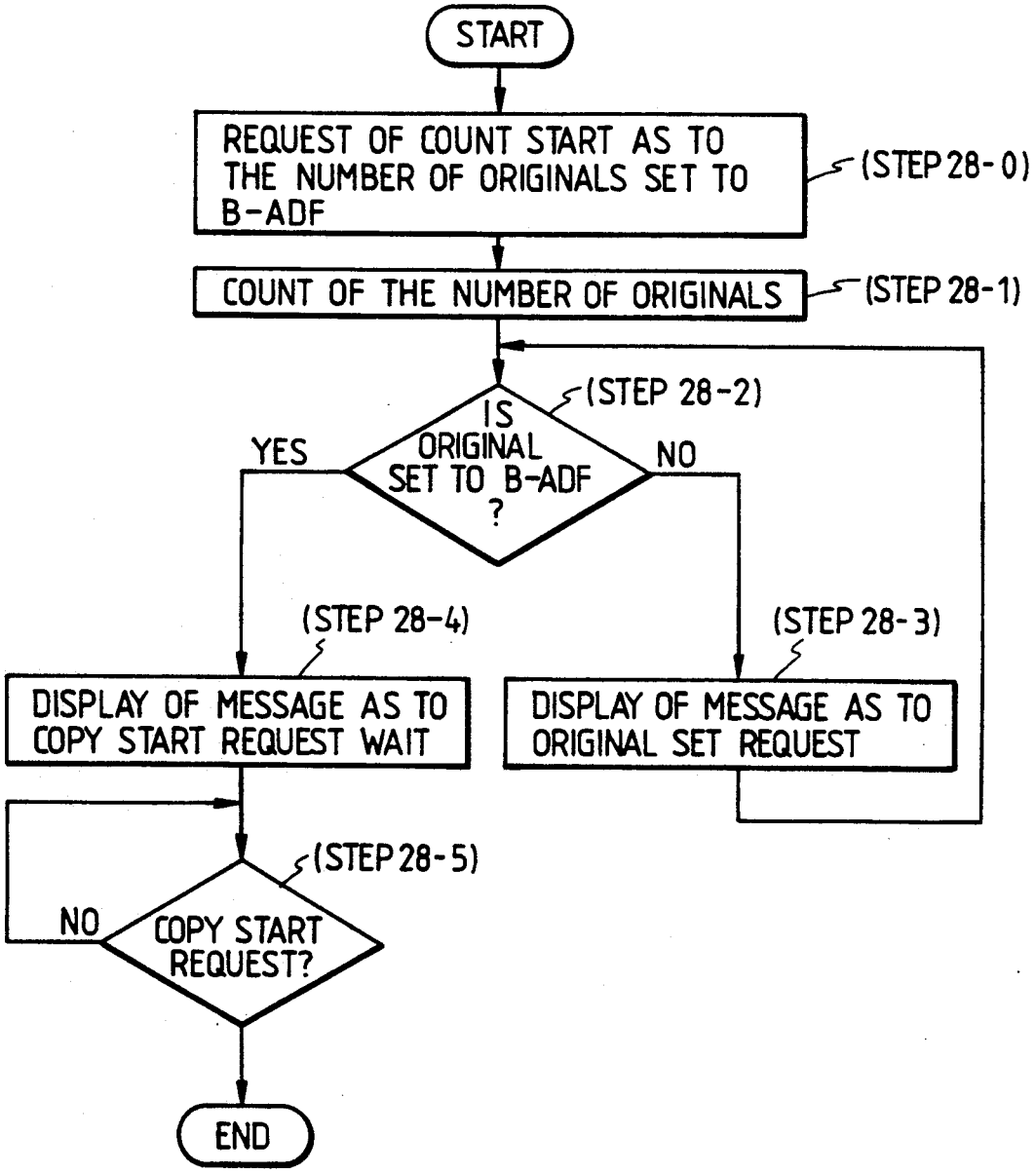

FIG. 7 composed of FIGS. 7A and 7B is a flow chart showing the control of not performing the sheet prefeed for the first circulation of documents and performing the pre-feed for the second and succeeding circulations;

FIG. 8 is a main flow chart showing the operation when the APS mode and cover mode are selected;

FIG. 9 is a flow chart showing the APS processing;

FIG. 10 is a main flow chart of another example of the operation when the APS mode and cover mode are selected;

FIG. 11 is a main flow chart showing the operation when the automatic cassette change mode and cover mode are selected;

FIG. 12 is a flow chart showing the routine for detecting the absence of sheet;

FIG. 13 is a cross sectional view showing the internal structure of another embodiment of the image forming apparatus to which the present invention is applied;

FIG. 14 is a plan view showing the operation panel of the apparatus shown in FIG. 13;

FIG. 15 composed of FIGS. 15A and 15B is a block diagrams showing the circuit of the control unit of the apparatus shown in FIG. 13;

FIG. 16 is a main routine showing the operation of the apparatus shown in FIG. 13;

FIGS. 17 to 24 are flow charts showing the operation when the cover mode is selected;

FIGS. 25 and 26 are views used for explaining the operation of obtaining both sides copies from one side originals;

FIG. 27 is a cross sectional view showing the internal structure of a further embodiment of the image forming apparatus to which the present invention is applied; and FIG. 28 is a flow chart showing the operation of the apparatus shown in FIG. 27.

DETAILED DESCRIPTION OF THE PREFERRED EMBODIMENT

Preferred embodiments of the present invention will be described in detail with reference to the accompanying drawings.

Figure 1:
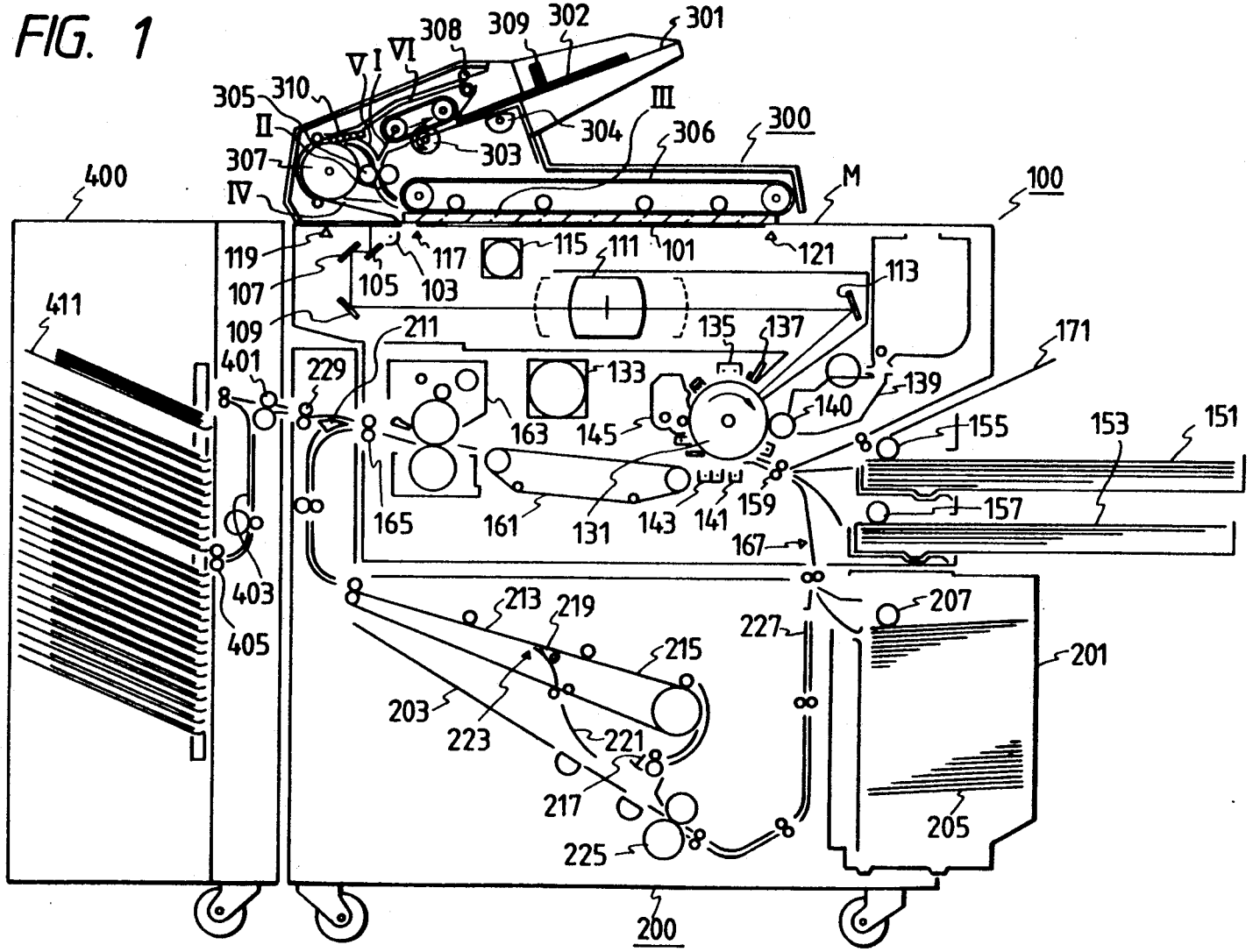
FIG. 1 is a cross sectional view showing the internal structure of the image forming apparatus to which the present invention is applied.

FIG. 1 shows the internal structure of an embodiment of a copying apparatus to which this invention is applied. The apparatus is constructed of a copying apparatus main body 100, a pedestal 100 having a two-sided recording function to turn over a recording medium (copying sheet) for allowing both front and back sides thereof to be copied, and a multi-recording function to allow a same recording medium to be copied plural times, a recycle document feeder (hereinafter called RDF) 300 which automatically feeds documents in a recycle manner, and a sorter 400 for sorting recorded sheets into a plurality of bins. The main body 100 can be used with a desired combination of the units 200 to 500.

A. Main Body 100

The main body 100 is constructed of an original support glass 101 on which an original is placed, an illumination lamp (exposure lamp) 100 for illuminating an original, scan reflection mirrors 105, 107 and 109 for changing the optical path of a reflected light from an original, a lens 111 having a focus and variable magnification function, a fourth scan reflection mirror 113 for changing the optical path, a motor 115 for driving the optical system, and sensors 117, 119 and 121.

The main body 100 is further constructed of a photosensitive drum 131, a main motor 133 for driving the photosensitive drum, a high voltage unit 135, a blank exposure unit 137, a developing unit 139, a developing roller 140, a transfer charger 141, a separation charger 143 and a cleaning unit 145.

The main body is further constructed of an upper cassette, a lower cassette 153, a manual sheet feed inlet, feed rollers 155 and 157, a registration roller 159, a transport belt 161 for transporting a recorded sheet to the fixing site, and a sensor 167 used for the two-sided recording.

The surface of the photosensitive drum 131 is made of a seamless photosensitive member constructed of a photoconductive film and an electric conductor. The drum 131 supported rotatably starts rotating in the direction indicated by the arrow upon actuation of the main motor 133 in response to depression of a copy start key to be described later. After completion of a predetermined rotation control and potential control process (preliminary process) of the drum 131, an original placed on the original support glass 101 is illuminated by the illumination lamp 103 which is mounted integrally with the first scan mirror 105. The reflected light from the original passes through the first, second and third scan mirrors 105, 107 and 109, lens 111 and fourth scan mirror 113 and is focussed onto the drum 131.

The drum 131 is charged by the high voltage unit 135 through corona discharge therebetween. Thereafter, an image (original image) illuminated by the illumination lamp 103 is slit-exposed to thereby form an electrostatic latent image on the drum 131 by means of a known Carson method.

Next, the electrostatic latent image on the photosensitive drum 131 is developed by the developing roller 140 and the developing unit 139 and visualized as a toner image which is transferred onto a copy or transfer sheet by the transfer charger 141.

Specifically, a transfer sheet within the upper cassette 151 or lower cassette 153 or from the manual sheet feeder inlet 171 is transported by the feed rollers 155 or 157 into the main body toward the photosensitive drum 131 in synchro with correct timings of the registration rollers 159 so that the front tips of the latent image and transfer sheet are correctly aligned. Thereafter, the transfer sheet passes between the transfer charger 141 and the drum 131 so that the toner image on the drum 131 is transferred onto the transfer sheet. After this transfer, the sheet is separated from the drum 131 with the aid of the charge eliminator 143 and guided to the fixing unit 163 by the transport belt 161 whereat it is fixed through pressure and heat. Then, the transfer sheet is discharged from the main body 100 by means of the discharge rollers 165.

The drum 131 continues rotating after the image transfer so that the surface thereof is cleaned with the cleaning unit 145 having a cleaning roller and a flexible blade.

B. Pedestal 200

The pedestal 200 can be dismounted from the main body, and has a deck 201 capable of accommodating 2000 transfer, sheets and an intermediate tray 203 for use in the two-sided copying. A lifter 205 of the deck 201 rises up by the amount corresponding to the number of transfer sheets so as to always make the transfer sheet contact the feed rollers 207.

The pedestal 200 is further constructed of a discharge flapper 211 for switching among the passage of the both sides recording site or multi-recording site and the discharge passage, transport passages 213 and 215 for a transport belt, and an intermediate tray weight 217 for pushing the transfer sheet. A transfer sheet passing through the discharge flapper 211 and passages 213 and 215 is caused to be turned over and accommodated within the intermediate tray 203 for the two-sided copying. A multiflapper 219 for switching between the passages of two-side recording and multi-recording is mounted between the transport passages 213 and 214. As the multi-flapper 219 moves upward, the transfer sheet is guided toward a multi-recording passage 221. A multi-discharge sensor 223 detects the back tip of a transfer sheet passing through the multi-flapper 219. Feed rollers 225 feed a transfer sheet from the passage 227 to the drum 131 site. Discharge rollers 229 discharge the transfer sheet outside the pedestal.

In the two-sided recording (both sides copying) or multi-recording (multi-copying), the discharge flapper 211 of the main body 100 is raised to feed a copied transfer sheet to the passages 213 and 215 of the pedestal 200 and accommodate it in the intermediate tray 203. In this case, the multi-flapper 219 is lowered for the body sides recording and raised for the multi-recording. The intermediate tray 203 can accommodate, e.g., 99 copied transfer sheets. The transfer sheets accommodated within the intermediate tray 203 are held down by the intermediate tray weight 217.

During the back side recording or multi-recording, transfer sheets within the intermediate tray 203 are guided one by one via the passage 227 to the registration roller 159 of the main body 100 with the aid of the feed rollers 225 and the weight 217.

C. RDF (Recycle Document Feeder) 300

In RDF 300, a set of documents 302 is placed on a tray, or mounting unit 301. In the case of one-sided documents, they are separated one by one starting from the bottom by half-moon rollers 304 and separation rollers 303. The separated one is fed via passages I to II by means of feed rollers 305 and a full length belt 306 to the exposure site at the platen glass 101 whereat the copying operation starts. After copying, it is sent by transfer large rollers 307 via passage III to passage V, and then returned by discharge rollers 308 onto the top of the documents 302. A recycle lever 309 is used in detecting one circulation of documents. The lever 309 is placed on the documents at the start of feeding the documents so that when the back tip of the last document passes the lever 309, it falls down by gravity to thus detect one circulation of the documents.

For the case of two-sided documents, a document is guided to the passages I, II and III as described above. Then, a rotatable flapper 310 is switched so as to guide the tip of the document to passage IV and thereafter, the document is fed by the feed rollers 305 to passage II and by the full length belt 306 to the platen glass 101. In other words, an original is turned over en route of passages III, IV and II by means of the transport large rollers 307.

The number of documents 302 can be counted while feeding them one by one through passages I, II, III, IV and VI until one circulation is detected by the recycle lever 309.

D. Sorter 400

The sorter 400 has 25 tray bins for sorting recorded sheets which are sequentially discharged by the discharge rollers 229 of the main body, guided to transport rollers 401, and accommodated within each bit 411 via passage 403 by discharge rollers 405. In the sort mode, each bin is moved upward by a bin shift motor (not shown) each time a recorded sheet is discharged into the associated bin.

Figure 2:
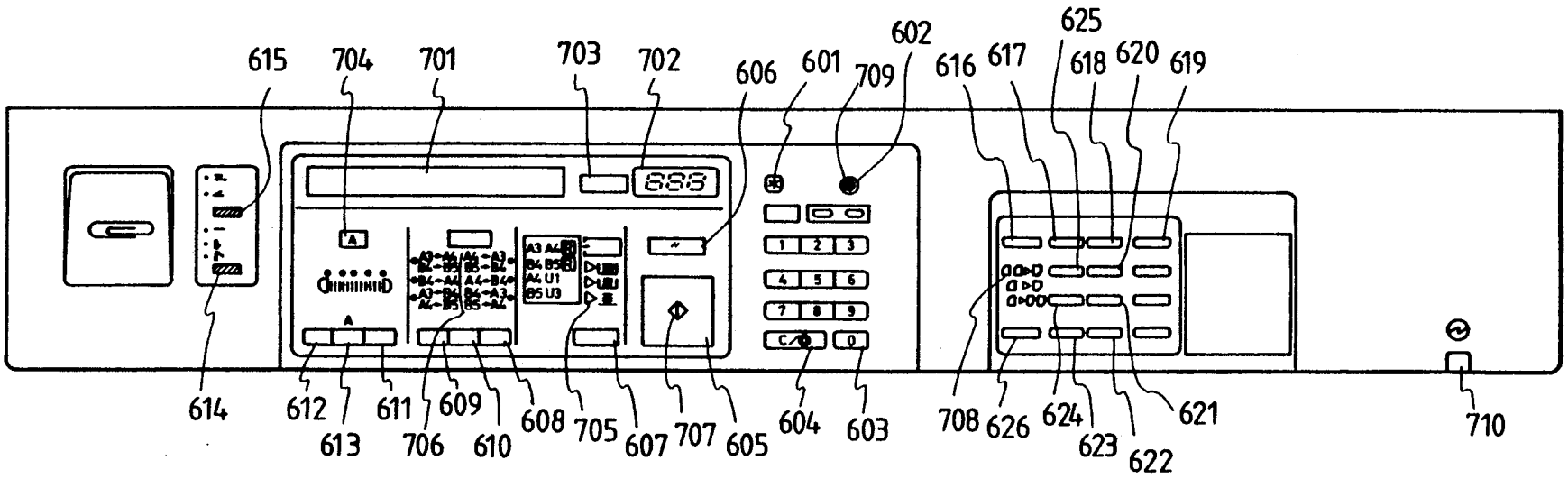
FIG. 2 is a plan view showing the operation panel of the image forming apparatus.

FIG. 2 shows an example of an operation panel mounted on the main body 100. The operation panel is constructed of a key group 600 and a display group 700 as described hereinafter.

E. Key Group 600

Referring to FIG. 2, an asterisk (*) key 601 is actuated by an operator or user for designating set mode such as for setting a binding margin, original frame erasure size and the like. An all reset key 606 is depressed when the apparatus is set to a standard mode. A pre-heat key 602 is depressed when the mechanics of the main body is required to be set in a pre-heat state, or to be released therefrom. This key 602 is also depressed when the standard mode is recovered from an automatic shut off state.

A copy start key 605 is depressed when a copy is to be started.

A clear/stop key 606 functions as a clear key during standby state, and a stop key during copying. The clear key is depressed to release the set number of copying sheets, and also used for releasing an asterisk (*) mode. The stop key is depressed to intercept consecutive copying so that the copying operation stops after the copy at the time of key depression is completed.

Ten keys 603 are used to set the number of copying sheets, and also used to set the asterisk mode. A memory key 619 can be used to register the modes an operator frequently uses. In this example, four modes M1 to M4 can be registered.

Copy density keys 611 and 612 are depressed when the copy density is manually adjusted. An AE key 613 is depressed when an automatic density adjustment is to be performed depending upon the density of an original, or when the automatic adjustment is released to be switched to a manual adjustment. A cassette selection key 607 is depressed to select one of the upper cassette 151, intermediate cassette 153 and lower paper deck 201. This key 607 can be used in selecting an APS (Automatic Paper Selection) mode while an original is being placed upon RDF 300. Upon selection of the APS mode, the cassette having the same size sheet as the original can be automatically selected.

An equal magnification key 610 is depressed when an equal magnification (equi-dimension) copy is desired. An automatic variable magnification key 616 is depressed to automatically reduce or magnify the size of the image of an original depending upon the selected transfer sheet. Zoom keys 617 and 618 are depressed to designate a desired magnification factor between 64 to 142 %. Regular magnification keys 608 and 609 are depressed to designate a regular size reduction or magnification.

A both sides key 626 is depressed for carrying out a copy operation from a one side original to a two-sided copy, from a two-sided original to a two-sided copy, or from a two-sided original to a one side copy. A binding margin key 625 is used for forming a binding margin having a designated width on the left side of a transfer sheet. A multi-key 623 is depressed to compose the images of two documents on one side of a transfer sheet.

An original frame erasure key 620 is depressed to erase the frame of a regular size original which size is set by the asterisk key 601.

A sheet frame erasure key 621 is depressed to erase the frame of an original in accordance with the size of a selected cassette.

A page consecutive copy key 622 is depressed to consecutively copy the right and left pages of an original onto different transfer sheets.

A discharge method (staple, sort, group) selection key 614 is used for selection or release of the staple mode and sort mode in the case where a stapler is operatively coupled to bind recorded sheets with staples, or for selection or release of the sort mode and group mode in the case where the sorter is coupled.

A sheet folding selection key 615 is used for selection or release of a Z-fold mode by which an A3 or B4 size recorded sheet is folded in Z-shape in cross section, or for selection or release of a half-fold mode by which an A3 or B4 size recorded sheet is folded in half.

F. Display Group 700

Referring again to FIG. 2, a message display 701 of LCD type is used for display of copy information. The information includes a 40 character sentence message with each character made of 5×7 dots, and a copy magnification factor set by the regular variable magnification keys 608 and 609, equal magnification key 610, zoom keys 617 and 18. This display is made of a semi-transmissive type liquid crystal, and back lights of two colors are used for radiating green backlight in an ordinary case and orange backlight in an abnormal case or copy disabled case.

An equal magnification display 706 is illuminated upon selection of an equal magnification. A color developing unit display 703 is illuminated upon setting a Sepia developing unit. A copy number display 702 is used for display of the number of copies or a self diagnosis code. A cassette display 705 is used for display of which one of the upper cassette 151, intermediate cassette 153 and lower deck 201 has been selected.

An AE display 704 is illuminated upon selection of an automatic density adjustment by the AE key 613. A pre-heat display 709 is caused to illuminate during a pre-heat state, and flush during an automatic shut off state. A ready/wait display 707 is made of green and orange color LEDs such that the green LED illuminates during a ready (copy enabled) state and the orange LED illuminates during a wait (copy disabled) state.

A both sides copy display 708 illuminates upon selection of either a copy mode from a two-sided document to a two-sided copy or a copy mode from a one-sided original to a two-sided copy.

If RDF 300 is used in the standard mode, the apparatus is set such that the number of copies is 1, under the conditions of the density AE mode, automatic paper selection (APS) mode, equal magnification, and a copy mode from a one side original to a one side copy. If RDF 300 is not used in the standard mode, the apparatus is set such that the number of copies is 1, under the conditions of the density manual mode, equal magnification, and a copy mode from a one-sided original to one-sided copy. The difference between use and non-use of RDF 300 depends on whether or not an original is being placed on RDF 300.

A power lamp 710 illuminates upon turning on a power switch.

Next, the asterisk mode will be described with reference to Table 1.

Each time the asterisk key 601 is depressed, the menu messages of the asterisk mode are sequentially displayed on the message display 701. The asterisk mode has 10 types of modes including memorizing a copy mode, setting a binding margin, setting an original frame erasure size, automatically setting a variable magnification factor, using documents of different sizes, setting an automatic clear, cleaning the charger, setting data and time, setting a cover mode, and setting an original automatic count mode.

In order to memorize a copy mode, prior to depressing the asterisk key 601, the number of copies, density and the like of the copy mode to be memorized are first set. Thereafter, the asterisk key 601 is depressed. Then, the memory key 619 is depressed following a second depression of the asterisk key 601, to thus memorize the set copy mode. This copy mode can be called upon depression of the memory key 619.

In order to set a binding margin, first the asterisk key 601 is depressed, and the number indicated at the column of binding margin setting of the menu message is inputted with the ten keys 604, to thus enter into the binding margin setting mode. The number of a desired binding margin indicated by the message is inputted with the ten keys 604, and the asterisk key 601 is again depressed to set the binding margin.

TABLE 1

| Function | Menu Message |
|---|---|
| Memorizing Copy Mode | Mode Memory (M1, M2, M3, M4)(*) |
| Setting Binding Margin | Change Binding Margin (1)(*) |
| Setting Original Frame Erasure Size | Change Frame Erasure Size (2)(*) |
| Automatically Setting Variable Magnification | Zoom Program (3)(*) |
| Using Documents of | Use Documents of Different Sizes |

TABLE 1-continued

| Function | Menu Message |
|---|---|
| Different Sizes | (4)(*) |
| Setting Automatic Clear | Change Automatic Clear Time (5)(*) |
| Cleaning Charger | Clean Wires (6)(*) |
| Setting Data & Time | Set Calendar (7)(*) |
| Setting Cover Mode | Set Cover Mode (8)(*) |
| Setting Original Automatic Count Mode | Count Originals (9)(*) |

In order to set an original frame erasure size, similar to the case of setting the binding margin, the original frame erasure setting mode is initiated using the asterisk key 601 and the ten keys 603. Using the zoom keys 617 and 618 as designated, a desired size is made displayed on the message display 701. Then, the asterisk key 601 is depressed to register the desired size.

In order to automatically set a variable magnification factor, similar to the case of setting the binding margin, the variable magnification automatic setting mode is initiated using the asterisk key 601 and the ten keys 603. The original size and the desired size are inputted using the asterisk key 601 and the ten keys 603 in accordance with the message. The variable magnification factor of magnification/reduction is calculated from the two inputted values and the calculated value is set.

In order to use documents of different sizes, similar to the case of setting the binding margin, the documents of different size using mode is initiated using the asterisk key 601 and the ten keys 603. Whether documents of different sizes are used or not is set using the key as indicated.

In order to set a time for automatically returning to the standard mode (automatic clear) if no operation is conducted after copying or after key operation, or in order to inhibit the automatic clear function, the automatic clear mode is initiated using the asterisk key 601 and the ten keys 603, similar to the case of setting the binding margin. Using the ten keys 603, a desired time is designated or the number corresponding to inhibition of the function is inputted.

In order to clean the charger, similar to the case of setting the binding margin, the charger cleaning mode is initiated using the asterisk key 601 and the ten keys 603. Upon depression of a designated key, cleaning the charger starts.

In order to set the date and time, similar to the case of setting the binding margin, the date and time setting mode is initiated using the asterisk key 601 and the ten keys 603. The date and time is inputted using the ten keys 603 and the asterisk keys 601 in accordance with the designated input method, following a depression of the asterisk key 601 to set the inputted date and time.

In order to set the cover mode, similar to the case of setting the binding margin, the cover mode is initiated using the asterisk key 601 and the ten keys 603. A mode for obtaining a copied cover or a mode for obtaining a not-copied cover is selected by a designated key. Then the asterisk key 601 is depressed to set the selected mode. The set cover mode is cleared upon depression of the reset key 606, by the automatic clear function, or upon turning off the power.

In order to set the original automatic count mode, similar to the case of setting the binding margin, the original automatic count mode is initiated using the asterisk key 601 and the ten keys 603. In this mode, the number of originals set on RDF is automatically counted. A designated key is actuated to effect the automatic count.

G. Control unit 800

Figure 6:
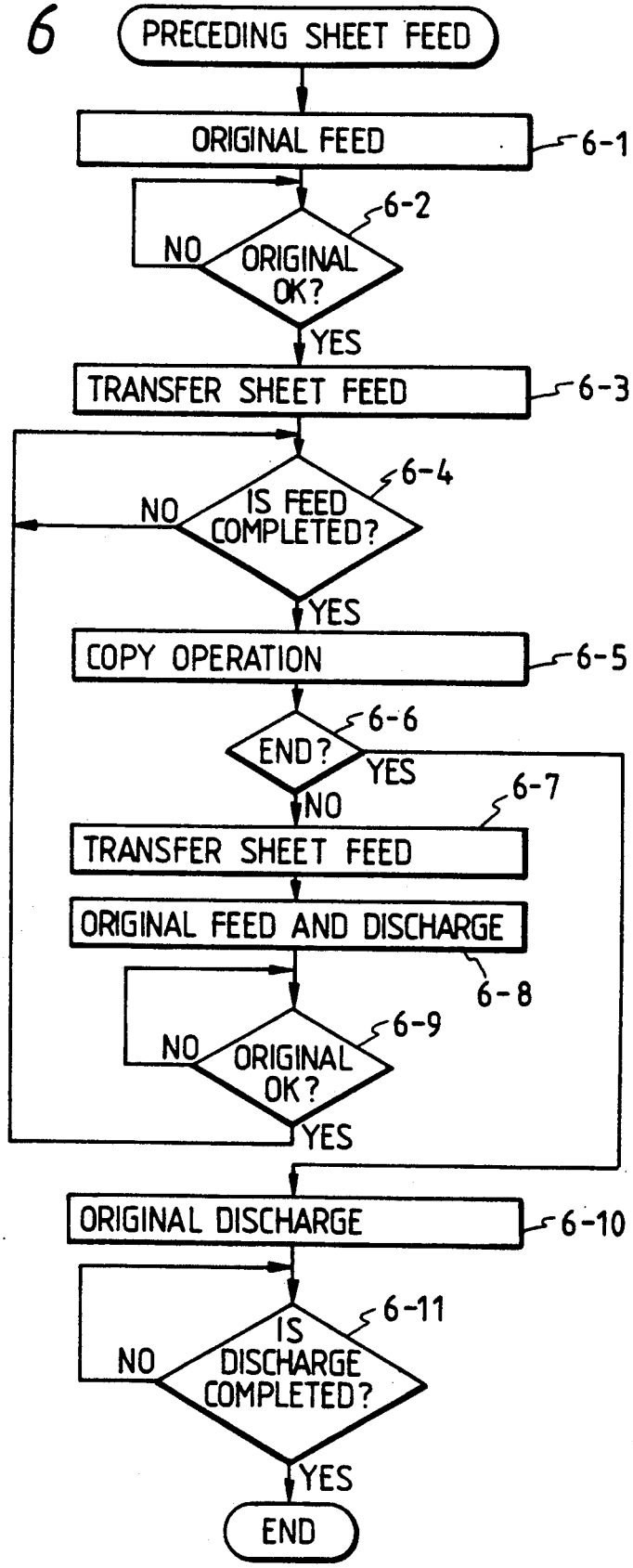
FIG. 6 is a flow chart showing the control of copying one document per one transfer sheet.

FIG. 3 shows an example of the circuit arrangement of the control device 800 of the embodiment shown in FIG. 1. Referring to FIG. 3, a central processing unit (CPU) 801 performs arithmetic and logical operations for practicing the present invention. CPU 801 may use a microcomputer V50 manufactured by NEC. A read only memory ROM 803 stores therein a control procedure (control program) of this invention as shown in FIG. 6. CPU 801 controls various units connected via a bus thereto in accordance with the control procedure stored in ROM 803. A random access memory RAM 805 serving as a main storage is used for storing input data and for a work memory area.

An I/0 interface 807 is used for outputting control signals from CPU 801 to the loads such as the main motor 133. An interface 809 sends signals inputted from the image tip sensor 121 and the like to CPU 801. An interface 811 controls input/output operations of the key group 600 and display group 700. These interfaces 807, 809 and 811 may use an input/output circuit port μPD 8255 manufactured by NEC.

The display group 700 shown in FIG. 2 is made of LEDs and LCDs, and the key group 600 are the keys shown in FIG. 2. CPU 801 can discriminate a depressed key by using a known key matrix.

Next, the operation of a sheet pre-feed mode will be described.

This mode aims at improving the efficiency of copy operation for one copy per one original with an original being set on RDF 300.

Referring now to the flow chart shown in FIG. 6, upon depression of the copy key, the first original is sent from RDF to the original support glass 101 (step 6-1) When the original stops on the original support glass 101 (step 6-2), a transfer sheet is fed from a selected one of the cassettes 151 and 153 and deck 201 having transfer sheets suitable for the original size. For example, if an A4 original to be subjected to an equal magnification copy is used and A4 transfer sheets are within the paper deck 201, then the deck is selected. Transfer sheets thus determined are used for the following copy operation (step 6-3). When the transfer sheet reaches the first registration roller 159 (step 6-4), a copy operation is carried out in accordance with a well known electrophotographic process (step 6-5). RDF informs if the present document is the last one or not, based on the operation of the recycle lever 309 (step 6-6). If there is the succeeding document, a transfer sheet is immediately fed from the paper deck (step 6-7). At the same time, the next original is fed (step 6-8) to the original support glass 101 (step 6-9) to then returned to step 6-4. Upon completion of a copy operation of the last document, the document is discharged (step 6-10). Upon completion of the discharge, the operation is terminated (step 6-11).

As described above, the size of a transfer sheet is first determined based on the first original. For the copy operation of the succeeding documents, a transfer sheet is pre-fed simultaneously with the feed/discharge operation of a document, thus improving the efficiency of copy operation.

Next, the operation of the cover mode will be described.

Figure 4:
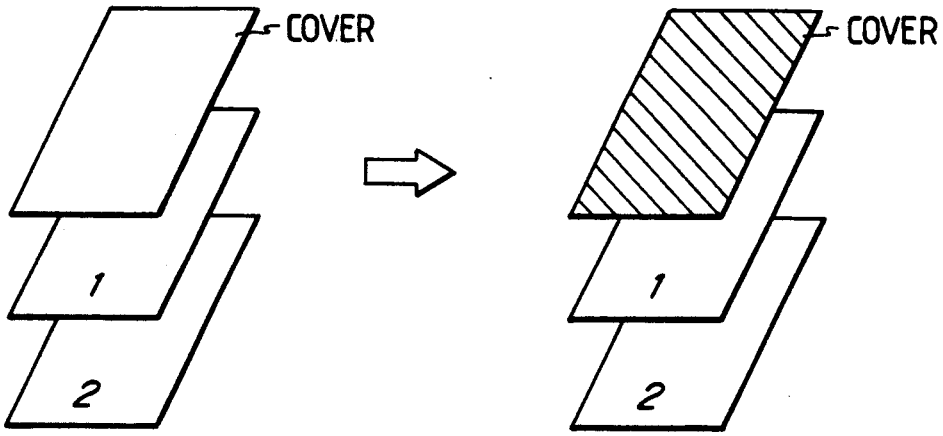
FIG. 4 is a view used for explaining the cover mode.
Figure 5:
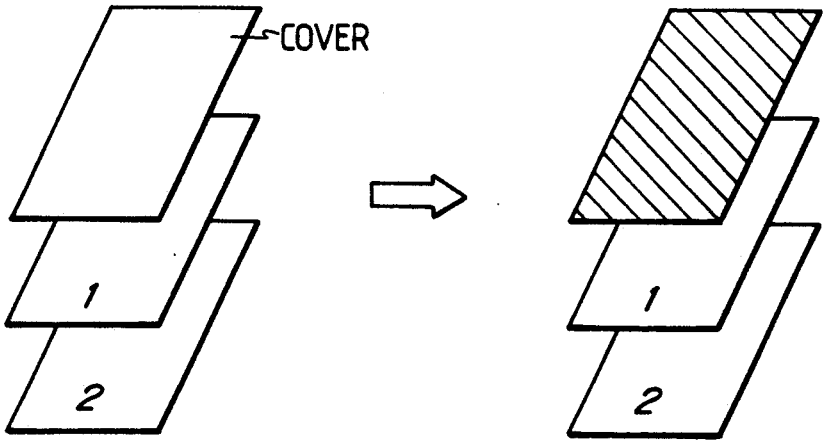
FIG. 5 is a view used for explaining the mode of obtaining a not-copied cover.

FIGS. 4 and 5 illustrate transfer sheets for the mode of obtaining a copied cover (FIG. 4) and for the mode of obtaining a not-copied cover (FIG. 5), both the modes being selectively set upon inputs from the operation unit described previously.

In this embodiment, a cover sheet is fed from the upper cassette 151 in which color sheets (e.g., pink) are set, and A4 size white sheets are set in the paper deck 201. Then, originals are placed on the original tray 301 of RDF 300 with their front side up. With the embodiment apparatus, a copy operation starts from the last original, and the copied sheets are stacked one upon another on the sorter 400 with the last original at the bottom.

The operation will be described with reference to FIG. 4. After copying the original page 2, the next original page 1 is fed and copied, and then the last cover original is copied. In this case, until such time when the last cover original is fed to the original glass 101, it has been detected by the recycle lever 309 that the original now on the original glass 101 is the last original. Then, a transfer sheet is fed from the upper cassette 151 to complete the copy operation as illustrated in FIG. 4. If the exposure process is not carried out, a not-copied transfer sheet is discharged as shown in FIG. 5.

The sorter 400 is mounted on the apparatus main body as shown in FIG. 1. However, the sorter may be dismounted therefrom, and the main body and RDF only may be used.

If the number of copies is set to 5, the originals circulate 5 times so that the pages of the documents can be arranged in consecutive order (this operation will be called RDF circulation mode hereinafter). If the RDF circulation mode and the cover mode are both employed, the start of the last document (cover document) cannot be identified so that the sheet pre-feed mode cannot be applied.

In view of this, if the cover mode is selected, a copy operation is carried out without employing the sheet pre-feed mode.

Alternatively, the following operation may be carried out to improve the efficiency of copy operation. During the RDF circulation mode, a copy operation is carried out without the sheet pre-feed at the time of first circulation to count the number of documents and memorize it. In accordance with the memorized number, a copy operation for the second and following circulations is carried out with the sheet pre-feed. For a copy operation of the last document, a cover sheet is pre-fed from the upper cassette. Therefore, a copy operation without the sheet pre-feed is only at the time of first circulation.

The above operation will be described with reference to the flow chart shown in FIG. 7.

Upon depression of the copy key 605, the first original is fed from RDF 300 (step 7-1). When the original stops at the original glass 101 (step 7-2), a transfer sheet whose size is suitable for the original is selected and fed (step 7-3). When the transfer sheet reaches the first registration roller 159 (step 7-4), a copy operation for the first original is carried out (step 7-5). It is checked if the copied transfer sheet is for the last original or not (in this embodiment, the last original corresponds to the original page 1 because the copy operation starts from the last original) (step 7-6). If not, then it is checked if the copy operation is in first circulation or not (step 7-7). If the document has not yet completed its first circulation after the copy operation start, the original on the original glass is discharged to feed the next original (step 7-8). Upon completion of feeding the original (step 7-9), it is checked if the original is the last original or not and if not (step 7-10), an ordinary copy transfer sheet selected at (step 7-3) is fed (step 7-11). If affirmative, a cover sheet is fed from the cassette 151 (step 7-12). Since the number of originals can be known at the second and following circulations (step 7-13), a cover sheet is pre-fed if the original is one before the last original (step 7-14). If not, an ordinary transfer sheet is fed (step 7-15). Simultaneously therewith, the original on the original glass is discharged to feed the next original (step 7-16). Upon completion of feeding the original, the procedure returns to step 7-4 to start the next copy operation immediately after completion of feeding the transfer sheet (step 7-17). An original number counter is decremented by 1 upon completion of a copy operation of the last original. In the original number counter, the number of originals has been inputted with the ten keys of the operation panel (step 7-18). When the count of the original number counter becomes 0, the copy operation terminates (step 7-19) so that the original is discharged (step 7-20) and the procedure is terminated upon completion of the discharge (step 7-21). If there are still originals remaining originals, the number of originals is held stored. The procedure returns to step 7-13 to continue a copy operation with the sheet prefeed (step 7-22).

As described above, in forming a necessary number of sets of cover and copied originals while circulating the originals, a copy operation for the first circulations is carried out without the sheet prefeed to count and memorize the number of originals. A copy operation for the second and following circulations is carried out with the sheet pre-feed in accordance with the memorized number of originals. The transfer sheet for the cover original is pre-fed from the cover sheet cassette. Accordingly, the efficiency of copy operation can be improved.

As appreciated from the foregoing, the transfer sheets and covers are pre-fed at the second and following circulations so that a copy operation time even for forming copied covers does not increase resulting in improved efficiency of copy operation.

Next, the case where both the cover mode and the APS mode are selected will be described in particular. In such a case, a plurality of sets of copies are formed for plural originals, and the cover for each set is supplied from a specific cassette. In this embodiment, it is assumed that cover sheets are accommodated within the upper cassette 151.

FIG. 8 shows the main flow chart of the operation. First, a depression of the copy key 605 is detected (step 8-1). Upon depression of the copy key 605, an original feed request issues against RDF 300 and thereafter, the procedure waits until the original is fed to the platen glass 101 (step 8-2). After feeding the original, the APS routine is performed whereby a proper size is selected based on the original size information and copy magnification factor from RDF 300 (step 8-3), (the APS routine will be described later). The original size is determined based upon the time required for the original to pass between sensors (not shown) mounted on the passage from the mounting tray 301 to the platen glass 101. It is next judged if the original is the last original (step 8-4). If not, transfer sheets are fed from the cassette 153 or the deck 201 selected at step 8-3 to carry out a copy operation for the necessary number of copies. If affirmative, the upper cassette 151 serving as the specific cassette for the cover mode is selected and switched thereto (step 8-5) to carry out a copy operation for the necessary number of cover sheets fed from the cassette (step 8-6). If the last original was processed at step 8-6, then the procedure terminates (step 8-7). If not the last original, then the procedure returns to step 8-2 (step 8-7).

Whether the original is the last one or not is determined by the operation of the recycle lever 309.

Next, the APS routine will be described which is illustrated in the flow chart shown in FIG. 9. First, a suitable size is selected based on the original size and copy magnification facter from RDF 300 (step 9-1). For example, in case of A4 size and 70% magnification factor, the A4 size cassette is selected as the candidate. It is judged if there is the cassette or deck having transfer sheets of the suitable size selected as the candidate (step 9-2). If not, the procedure advances to step 9-5 and the following steps. If present, it is judged if the cassette or deck is the specific cassette for the cover mode (step 9-3). If it is the specific cassette, the selection of the specific cassette is inhibited to thus advance to (step 9-5). If not, the cassette is selected (step 9-4) to return to the main routine.

In the process of no suitable cassette, a message to the effect that no suitable cassette is present is displayed on the operation panel (step 9-5) to wait for replacement with the suitable size cassette (step 9-6). After the replacement, the procedure returns to the main routine.

Next, the case where copy operation is inhibited will be described, for the case where the size of transfer sheets in the cassette selected with the aid of the APS function differs from the size of cover sheets.

FIG. 10 is the main flow chart of the operation according to an embodiment. First, the originals are set on the mounting tray 301 of RDF 300 (step 10-1). The APS mode is selected (step S10-2) and the cover mode is selected (step S10-3). Then, a depression of the copy key 605 is detected (step S10-4). When the copy key 605 is depressed, the original is fed (step S10-5) and the size is detected while transporting the original to select the cassette of that size (step S10-6). The selected cassette size and the cover cassette size are compared with each other (step S10-7). If the sizes are different, the copy operation is inhibited (step S-10-8) to output a message such as "cover size different" on the display unit 701 of the operation panel (S10-9). As above, at the copy operation of the first original, an alarm issues based on the comparison between the selected cassette size and the last original cover cassette size, so that the operator is notified on such effect at the earlier time, resulting in avoiding possible erroneous operation by the operator.

If the sizes are the same at step S10-7, transfer sheets are fed until the last original comes (step S10-10) to carry out a copy operation for the necessary number of originals (step S10-12) and repeat feeding the originals (step S10-14). In case of the last original at step S10-10, the cover sheet cassette is selected for the first time (step S10-11) to carry out a copy operation for the necessary number of covers (step S10-12) and thereafter, terminate the procedure of the cover copy mode operations.

The above example is for the case where both the cover mode and the APS mode are selected. In this embodiment, cover sheets each for the necessary number of originals are fed from the specific cassette. However, this embodiment is also applicable to other cases such as where a specific sheet is inserted for a desired number of copied originals, where a copied specific sheet is inserted, and the like operation modes.

As described so far, even the cover mode is performed during the APS mode, the specific cassette is excluded from the selection object of the APS mode so that the specific cassette cannot be selected for transfer sheets, thus avoiding erroneous operation by an operator.

Further, in performing the APS function during the cover mode, if the selected transfer sheet size differs from the specific sheet size, the image forming operation is inhibited so that unnecessary sets of copies which the operator does not intend are prevented from being formed.

There is known a copying apparatus capable of operating at a so-called automatic cassette change (ACC) mode wherein when all transfer sheets within a selected cassette have been consumed during the copy operation, another cassette having transfer sheets of the same size is checked, and if present, the cassette is automatically changed to continue the copy operation.

Next, an example will be described with reference to the flow charts shown in FIGS. 11 and 12, wherein during a copy operation using such a copying apparatus in the cover mode, the sheet feed cassette is not changed to the cassette (upper cassette 151) accommodating cover sheets even upon operation of the ACC function.

FIG. 11 is the main flow chart of the operation.

First, a depression of the copy key 605 is detected (step 11-1). Upon depression of the copy key 605, an original feed request issues against RDF 300, and the procedure waits until such time when the original is fed to the platen glass 101 (step 11-2). After feeding the original, it is judged if the fed original is the last one or not (step 11-3). If it is the last one, the sheet feed cassette is changed to the upper cassette 151 serving as the specific cassette for the cover mode (step 11-4). It is checked if there still remain transfer sheets in the presently selected cassette 153 or deck 201 (step 11-5) (this sheet presence/absence routine will be described later). Thereafter, a copy operation is carried out for a set number of necessary copies (step 11-6). Upon completion of the copy operation, it is checked whether or not there is an original to be next fed, i.e., it is checked if the present original is the last one or not (step 11-7). If not, the procedure returns to step 11-2 to repeat the above operations.

The check of the last original is performed by the operation of the recycle lever 309.

The sheet presence/absence check flow chart for a presently selected cassette is shown in FIG. 12.

First, it is checked if there still remain transfer sheets in the presently selected cassette or deck (step 12-1). If present, the procedure returns to the main routine. If not, it is checked if the ACC mode has been selected and is now valid (step 12-2). If valid, the automatic cassette change function is carried out. If not valid, the sheet absence processes are carried out starting from step 12-6.

The automatic cassette change function is a function to automatically select a cassette or deck having transfer sheets of the same size when all transfer sheets within the presently selected cassette or deck have been consumed fully.

If the automatic cassette change mode has been selected at step 12-2, then it is checked if there is a cassette or deck having transfer sheets of the same size (step 12-3). If not, the sheets absence processes are carried out starting from the step 12-3. If affirmative, it is checked if the cassette or deck is the specific cassette for the cover mode or not (step 12-4). If it is the specific cassette, the automatic cassette change function is inhibited to carry out the sheet absence processes from step 12-6. If not the specific cassette, the cassette or deck of the same size is selected (step 12-5) to return to step 12-1 whereat it is checked if there still remain transfer sheets.

The sheet absence processes after step 12-6 will then be described.

If there is no transfer sheet, a "no sheet" is displayed on the operation panel to notify the operator of such effect (step 12-6). The procedure waits for replenishment of transfer sheets within the presently selected cassette or deck (step 12-7) and thereafter, returns to the main routine.

The flow charts for the ACC function during the cover mode have as described above. In this embodiment, cover sheets each for the necessary number of originals are fed during the cover mode. However, this embodiment is also applicable to other cases such as where a specific sheet is inserted for a desired number of copied originals, where a copied specific sheet is inserted, and the like operation modes.

As described so far, the embodiment solves the problem that the specific cassette for cover sheets is selected during the cover mode upon operation of the ACC function.

Next, a further embodiment of the present invention will be described with reference to the accompanying drawings. In this embodiment, a color developing unit in addition to a black developing unit are provided within a copying apparatus.

FIG. 13 is a cross sectional view showing the internal structure of the copying apparatus of this embodiment, wherein those elements designated by identical reference numerals have the same structure as the corresponding ones shown in FIG. 1. A blank exposure unit 170 is constructed of LEDs disposed at 2.5 mm pitch in the drum shaft direction. A potential sensor 171 detects the potential of the photosensitive drum 131. A color developing unit 172 and black developing unit 173 are detachably mounted on the apparatus main body. Original size detection sensors 176, 177 and 178 detect presence/absence of an original placed on the original support glass. A sensor 179 detects the time immediately before RDF or a pressure plate (not shown) is closed.

FIG. 14 shows an example of the operation panel of the copying apparatus of this invention, wherein those elements designated by identical reference numerals have the same structure as the corresponding one shown in FIG. 2. A developing unit selection key 630 is used to select the black and color developing units alternately upon depression of the key. The developing unit selected by the selection key 630 is displayed on a display 730. For example, if a cover is to be copied by using the color developing unit, the key 630 is depressed to select the color developing unit after selecting the cover mode. It is also possible to perform an ordinary copy operation using the color developing unit, or perform a cover copy operation using the black developing unit. Reference numeral 712 represents a power switch.

FIG. 15 composed of FIGS. 15A and 15B is a block diagram showing an example of the control unit 800 of the embodiment shown in FIG. 13, wherein those elements designated by identical reference numerals have the same structure as the corresponding ones shown in FIG. 3.

Data are written in or read out from a dual port RAM (DPRAM) 813 to conduct date transfer between CPU 801 and CPU 814.

CPU 814 controls the blank exposure unit 170 in accordance with the blank data calculated by CPU 801. Signals from the potential sensor 171 and size detection sensors 176, 177 and 178 are A/D converted and transferred via DPRAM 813 to CPU 801.

A watch dog circuit 812 monitors an abnormal state of CPU 801. Upon detection of an abnormal state, the circuit outputs a reset signal to CPU 801 and CPU 814.

A power source 815 supplies power to the apparatus. A circuit 816 converts 24V (on) and 0V (off) into 5V and 0V in response to turning on and off of a power switch 712. CPU 801 detects the turning on and off of the power switch and stops driving all the loads.

A copy operation with the cover mode selected will be described in particular. The mode to be described below is set such that n one-sided originals are copied onto two sides of the transfer sheets under the RDF circulation mode, and the cover sheet for the last original is fed from the specific cassette.

FIG. 16 shows the main routine flow chart of the operation.

When the copy key is depressed (step 16-1), it is checked if the cover mode has been selected (step 16-2). If selected, a cover mode copy operation is performed (step 16-3).

The flow charts for the cover mode copy operation are shown in FIGS. 17 to 24. FIGS. 25 and 26 illustrate the cover mode copy operation.

Figure 22:
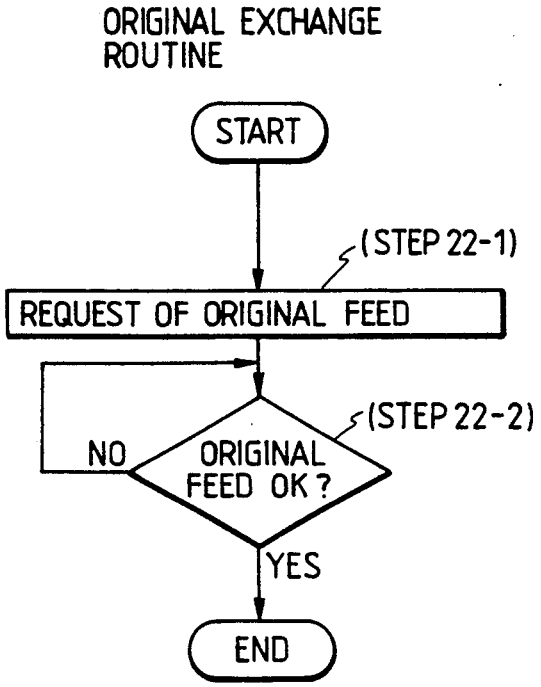

After depression of the copy key 605 and selection of the cover mode copy operation, an original number count request issues against RDF 300 (step 17-1) to circulate the originals for counting the number thereof prior to starting the copy operation (step 17-1). Next, it is judged if a mode of obtaining a one-sided copy for only the cover has been selected, and if not (step 17-2), an original exchange is carried out (step 17-3). The original exchange routine is shown in FIG. 22. In this embodiment, the "original exchange" means the processes that an original feed request issues against RDF (step 22-1) and the fed original stops at the platen glass (step 22-2). The original exchange hereinafter used in the specification corresponds to the above processes.

Only for the case when the counted number of originals is odd (step 17-4), a copy sheet is fed from the cassette selected by the key on the operation unit (steps 17-5 and 17-6).

Figure 23:
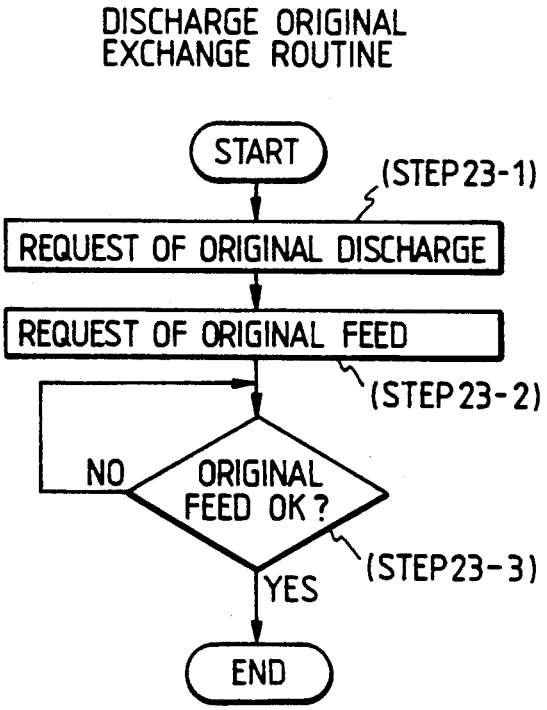

First, a copy operation is carried out with all the LEDs 171 turned on to obtain a back side blank copy sheet (step 17-7). Thereafter, the copy sheet is transformed to the intermediate tray 203 (step 17-8). Next, the copy sheet is fed from the intermediate tray (step 17-9). Then, a copy operation is carried out to copy the original fed during the RDF circulation mode on the front side of the copy sheet (step 17-10). Thereafter, the copy sheet is discharged into the sorter 400 (step 17-11), and at the same time a discharge original exchange routine for the next copy operation is executed such that the next original is fed to the original platen 101 and the original on the platen is returned to the tray 301 of RDF 300 to thus perform an original exchange (the operation is called hereinafter "discharge original exchange") (step 17-12). The details of the discharge original exchange routine is shown in FIG. 23, the routine includes the processes that original discharge request and original feed request issue against RDF and the next original stops at the original platen.

In the following steps, the same operation is carried out for both the even and odd numbers of originals counted at step 17-4. It is checked if the last copy sheet (for the original before the last original) was fed (step 18-1). If the last copy sheet, the cassette is changed to the upper cassette serving as the specific cassette for the cover mode, and a cover sheet is fed (steps 18-2, 18-3). After execution of a back side copy process (step 18-4), the copy sheet is transported to the intermediate tray 203 (step 18-5) and a discharge original exchange is performed similar to the case at step 17-2 (step 18-6).

Figure 24:
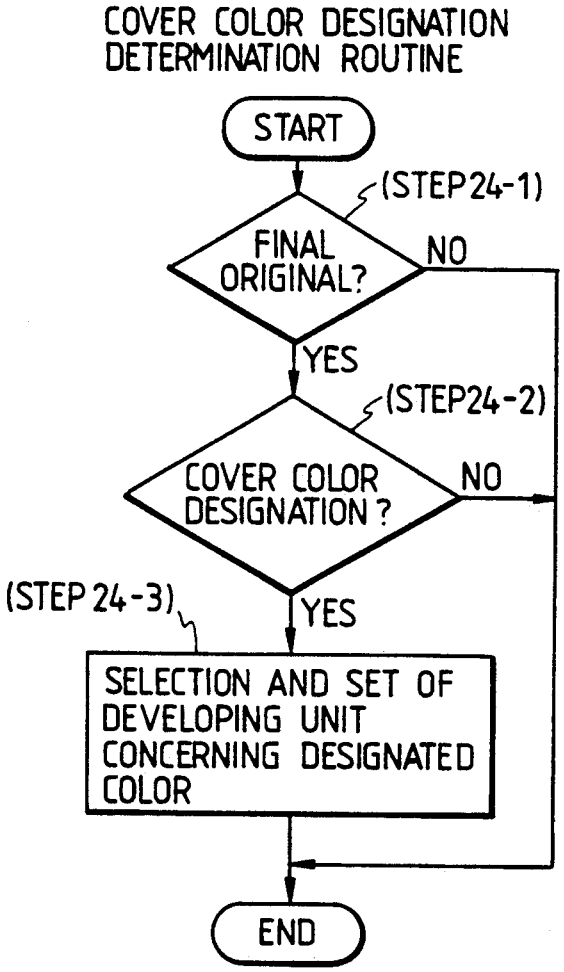

Then, a cover color designation determination routine is executed (step 18-7) the details of which are shown in FIG. 24. In this routine, first it is checked if the original is the last original or not (step 24-1). If it is the last original and a copy color has been designated, the color developing unit as designated is selected and set (steps 24-2, 24-3). Thus, the cover can be copied with a designated color.

Next, the copy sheet is fed from the intermediate tray 203 (step 18-8). A copy operation is executed to copy the original fed at the RDF circulation mode on the front side of the copy sheet (step 18-9). Thereafter, the copy sheet is discharged (step 18-10). Then, it is checked if there is an original to be next fed (step 18-11). If not, an original discharge request issues against RDF 300 to discharge the original and terminate the copy operation. In an alternative case, the discharge original exchange is executed (step 18-13) to return to step 18-1 and repeat the above operations.

If a mode of obtaining a one-sided copy of the cover only has been selected (step 17-2), first the original exchange is carried out (step 19-1). It is checked if the counted number of originals is even (step 19-2). For the even case only, the operations are carried out similar to steps 17-5 to 17-12 (steps 19-3 to 19-10). Thereafter, the same operations are conducted for both the even and odd original numbers. It is checked if the fed original is the last original or not (step 20-1). If it is the last original, the sheet feed cassette is changed to the upper cassette 151 serving as the specific cassette for the cover mode, and a cover sheet is fed (steps 20-2, 20-3). The cover mode, and a cover sheet is fed (steps 20-2, 20-3). The cover color designation determination routine is executed similar to the case at steps 18-7 to 18-10 (steps 21-3) such that a front side copy operation is carried out (steps 21-3 to 21-5) and thereafter, an original discharge request issues against RDF 300 to discharge the original (step 21-6) and terminate the copy operation. If the fed original is not the last original (step 20-1), a back side copy operation is executed similar to the case at steps 18-3 to 18-6 (steps 20-2 to 20-5). Thereafter, a front side copy operation is executed similar to the case at steps 18-8 to 18-10 (steps 20-6 to 20-8) to thereafter return to step 20-1 to repeat the succeeding operations.

As described above, the number of originals is counted during the cover mode, and the counted number is taken into consideration during the mode of obtaining a two-sided copy from a one-sided original. Therefore, the embodiment allows to, perform the two-sided copy operation for a one-sided original during the cover mode (refer to FIG. 25), and perform the two-sided copy operation for a one-sided original as well as the two-sided copy operation only for the cover during the cover mode (refer to FIG. 26).

Next, a still further embodiment of this invention will be described wherein an automatic document feeder (ADF) is used instead of the above-described recycle document feeder (RDF).

FIG. 27 is a cross sectional view showing the schematic construction of a copying apparatus equipped with ADF. In FIG. 27, those elements designated identical difference numerals have the same structure to the corresponding elements shown in FIG. 13. ADF has an original reversal mechanism and can handle a both sides original (such ADF is called hereinafter B-ADF). Originals placed on an original tray 901 are separated one by one from the bottom thereof by separation rollers 902, transported to the platen glass 101 by means of transport rollers 903 and a full length belt 904, and stopped at the exposure site. After the copy operation, the original is fed in the direction indicated by the arrow by means of the full length belt 904, turned over by discharge rollers 905, and discharged onto a discharge tray 906. The count operation of documents can be effected without stopping the original at the exposure site such that documents are separately fed from the original tray 901 one by one and discharged while counting the number of originals.

The operation will now be described. In the operation, steps 17-0 and 17-1 are replaced with the processes shown in FIG. 28.

Upon request of counting the number of original set at B-ADF 900 (step 28-0), the originals are sequentially fed and discharged while counting the number of originals (step 28-1). If the discharged originals are not set again at B-ADF 900 (step 28-2), a message indicating that the originals be set at B-ADF is displayed on a message display 701 (step 28-3). After the originals have been set at B-ADF, a copy start request wait message is displayed on the message display 701 (step 28-4) to wait for a copy start request (step 28-5). Upon reception of the copy start request, the procedure advances to the process at step 17-2 shown in FIG. 17. As above, the number of originals can be counted.

The procedure thereafter is the same as the case using RDF, so the description therefor is omitted.

As described so far, prior to transporting originals for the copy operation, the originals are first transported for counting the number thereof. Therefore, in accordance with the counted number, a specific sheet can be fed as a cover sheet or a separation sheet, resulting in improved handy method for use. Further, in a two-sided copy operation from a one-sided original during the cover mode, a cover not copied on its back side can be reliably obtained. Furthermore, a cover with a different color image copied thereon can be obtained without giving any inconvenience to an operator.

In the above embodiments, a copying apparatus using the electrophotographic process has been described. However, the invention is not limited thereto, but various copying apparatus using ink jet recording, thermal recording and the like are also applicable.

We claim:

1. An image forming apparatus comprising:

original circulation means for feeding originals placed on an original mounting unit one by one to an exposure site and after the exposure, returning the original to the original mounting unit;

copying means for copying an original image to a recording sheet through exposure of the original at said exposure site;

first transport means for feeding said recording sheet to a copy site;

first control means for performing the original circulation by said original circulation means for a set number of times to obtain said number of copies;

second transport means for feeding a specific sheet for each circulation of said originals; and second control means for controlling said first and second transport means to pre-feed said recording sheet and said specific sheet to be next supplied during a copy operation;

wherein said second control means does not perform said pre-feed of said recording sheet and said specific sheet during the first circulation of said originals by said original circulation means, performs said pre-feed of said recording sheet and controls said first and second transport means to pre-feed said specific sheet, during a copy operation for the second and succeeding circulations of said originals.

2. An image forming apparatus according to claim 1, wherein said second control means counts the number of said originals during the first circulation thereof, and pre-feeds said recording sheet and said specific sheet during the second and succeeding circulations in accordance with said counted value.

3. An image forming apparatus comprising:

first detection means for detecting an original size;

a plurality of accommodating means for accommodating a recording sheet;

second detection means for detecting the size of said recording sheet accommodated in said plurality of accommodating means;

selection means for selecting one of said plurality of accommodating means accommodating said recording sheet having a suitable size, based on the original size data inputted from said first detection means and the recording sheet size data outputted from said second detection means;

copy means for copying an original image to said recording sheet fed from the accommodating means selected by said selection means;

specific accommodating means for accommodating a specific sheet;

feed means for feeding said specific sheet from said specific accommodating means for each of a predetermined copy operation; and control means for inhibiting said selection means to select said specific accommodating means.

4. An image forming apparatus comprising:

first detection means for detecting an original size;

a plurality of accommodating means for accommodating a recording sheet;

second detection means for detecting the size of said recording sheet accommodated in said plurality of accommodating means;

selection means for selecting one of said plurality of accommodating means accommodating said recording sheet having a suitable size, based on the original size data outputted from said first detection means and the recording sheet size data outputted from said second detection means;

copy means for copying an original image to said recording sheet fed from the accommodating means selected by said selection means;

specific accommodating means for accommodating a specific sheet;

feed means for feeding said specific sheet from said specific accommodating means for each of a predetermined copy operation; and control means for controlling a copy operation when the size of said recording sheet accommodated within said accommodating means selected by said selection means differs from the size of said specific sheet.

5. An image forming apparatus according to claim 4, wherein said control means stops a copy operation.

6. An image forming apparatus comprising:

a plurality of accommodating means for accommodating a recording sheet;

copy means for copying an original image to said recording sheet fed from one of said plurality of accommodating means;

sheet feed control means for continuing a copy operation by said copy means, if said recording sheet becomes absent within a selected one of said accommodating means during said copy operation, by changing said selected one to another accommodating means;

specific accommodating means for accommodating a specific sheet;

sheet feed means for feeding said specific sheet from said specific accommodating means for each predetermined copy operation; and inhibition means for inhibiting said switch operation to said specific accommodating means by said sheet feed control means.

7. An image forming apparatus comprising:

original circulation means for feeding originals placed on an original mounting unit one by one to an original site and after the exposure, discharging the original to said original mounting unit;

copying means for copying an original image to a recording sheet through exposure of the original at said exposure site;

feed means for feeding a specific sheet for each circulation of said originals;

selection means for selecting a feed mode in which said feed means feeds the specific sheet; and control means provided with a first mode in which the number of originals placed on said original mounting unit is initially counted by said original circulation means and a second mode in which the number of originals is not initially counted, said control means providing such a control than when the feed mode is selected by said selection means, said first mode is executed prior to the original circulation for the copying operation.

8. An image forming apparatus comprising:

first feed means for feeding a recording sheet;

copy means for copying mutually different original images on both sides of the recording sheet fed by said first feed means;

second feed means for feeding a specific sheet for each predetermined copy operation; and control means for controlling said copy means to inhibit a two-sided copy operation for said specific sheet wherein said control means controls said copy means such that said specific sheet is subjected to a one-sided copy operation and thereafter discharged.

9. An image forming apparatus according to claim 8, wherein said copy means includes original transport means for transporting said original to an exposure site, and said control means actuates said original transport means to count the number of said original.

10. An image forming apparatus according to claim 9, wherein said control means controls said copy means to inhibit the two-sided copy operation for said specific sheet in accordance with said counted number of said original.

11. An image forming apparatus comprising:

first feed means for feeding a recording sheet;

second feed means for feeding a specific sheet for a predetermined image forming operation;

image forming means for performing image formation with a first color or a second color to the recording sheet fed by said first feed means or the specific sheet fed by said second feed means;

selection means for selecting a specific mode; and control means responsive to selection of the specific mode by said selection means for controlling said image forming means so as to perform said image formation with the first color to the recording sheet and so as to perform the image formation with the second color to said specific sheet.

12. An image forming apparatus according to claim 11, wherein said image forming means forms an image by forming an electrostatic latent image on a photosensitive member, and after developing, transferring and fixing said latent image onto a recording sheet or said specific sheet.

13. An image forming apparatus according to claim 12, wherein said image forming means includes a plurality of developing means, and said control means selects one of said developing means in accordance with an image forming color designated by said designation means to form an image on said specific sheet.

* * * * *

UNITED STATES PATENT AND TRADEMARK OFFICE

CERTIFICATE OF CORRECTION

PATENT NO. :5,079,598

DATED :January 7, 1992

INVENTOR(S) :Tokuharu Kaneko, et al.

It is certified that error appears in the above-identified patent and that said Letters Patent is hereby corrected as shown below:

IN THE DRAWINGS

FIGURE 3

In logic block 159, "CLATCH" should read --LATCH--.

FIGURE 7A

In logic block 7-7, "CIRCURATION" should read --CIRCULATION--.

FIGURE 9

In step 9-6, "CASETTE" should read --CASSETTE--.

FIGURE 15B

In logic block 159, "CLATCH" should read --LATCH-- and in logic block 117, "SEN ER" should read --SENSOR--.

COLUMN 1

Line 55, "one side" should read --one-sided-- and "the both" should read --two--;

Line 56, "both sides" should read --two-sided--; and

Line 57, "one side" should read --one-sided--.

UNITED STATES PATENT AND TRADEMARK OFFICE

CERTIFICATE OF CORRECTION

PATENT NO. :5,079,598

DATED :January 7, 1992

INVENTOR(S) :Tokuharu Kaneko, et al.

It is certified that error appears in the above-identified patent and that said Letters Patent is hereby corrected as shown below:

COLUMN 2

Line 52, "two sides" should read --two-sided-- and "one sided" should read --one-sided--; and
Line 54, "objects" should read --object--.

COLUMN 3

Line 54, "diagrams" should read --diagram--; and
Line 62, "both sides" should read --two-sided-- and "one side" should read --one-sided--.

COLUMN 4

Line 3, "EMBODIMENT" should read --EMBODIMENTS--;
Line 19, "500." should read --400.--;
Line 24, "lamp) 100" should read --lamp) 103--; and
Line 38, "cassette," should read --cassette 151,-- and "inlet," should read --inlet 171,--.

COLUMN 5

Line 25, "transfer," should read --transfer--;
Line 31, "both" should read --two-sided--;
Line 32, "sides" should be deleted;
Line 41, "214." should read --215.--;
Line 54, "body" should read --two-sided--; and
Line 55, "sides" should be deleted.

UNITED STATES PATENT AND TRADEMARK OFFICE

CERTIFICATE OF CORRECTION

PATENT NO. :5,079,598

DATED :January 7, 1992

INVENTOR(S) :Tokuharu Kaneko, et al.

It is certified that error appears in the above-identified patent and that said Letters Patent is hereby corrected as shown below:

COLUMN 6

Line 51, "is" should read --are--; and
Line 57, "key 606" should read --key 604--.

COLUMN 7

Line 25, "one side" should read --one-sided--;
Line 27, "one side" should read --one-sided--; and
Line 60, "zoom" should read --and zoom-- and "18." should read --618.--.

COLUMN 8

Line 8, "flush" should read --flash--;
Line 22, "one side" (both occurrences) should read --one-sided--;
Line 41, "data" should read --date--;
Line 55, "keys 604," should read --keys 603,--; and
Line 58, "keys 604," should read --keys 603,--.

COLUMN 9

Line 6, "data" should read --date--; and
Line 15, "made" should be deleted.

UNITED STATES PATENT AND TRADEMARK OFFICE

CERTIFICATE OF CORRECTION

PATENT NO. 5,079,598

DATED January 7, 1992

INVENTOR(S) Tokuharu Kaneko, et al.

It is certified that error appears in the above-identified patent and that said Letters Patent is hereby corrected as shown below:

COLUMN 12

Line 24, "remaining originals," should read --remaining--; and
Line 30, "circulations" should read --circulation--.

COLUMN 13

Line 22, "to" (second occurrence) should be deleted.
Line 36, "(step 10-1)." should read --(step S10-1).--; and
Line 51, "on" should read --of--.

COLUMN 14

Line 4, "the" (second occurrence) should read --and the--; and
Line 68, "sheets" should read --sheet--.

COLUMN 15

Line 18, "have" should read --are--; and
Line 32, "are" should read --is--.

COLUMN 16

Line 4, "date" should read --data--;
Line 53, "LEDs 171" should read --LEDs--;
Line 55, "formed" should read --ferred--; and
Line 68, "is" should read --are--.

UNITED STATES PATENT AND TRADEMARK OFFICE

CERTIFICATE OF CORRECTION

PATENT NO. 5,079,598 Page 5 of 5

DATED January 7, 1992

INVENTOR(S) Tokuharu Kaneko, et al.

It is certified that error appears in the above-identified patent and that said Letters Patent is hereby corrected as shown below:

COLUMN 17

Line 46, "mode," should read --mode is set,--; and

Line 63, "to," should read --to--.

COLUMN 18

Lines 8-9, "designated identical difference numerals" should read --designated with identical reference numerals--;

Line 10, "both sides" should read --two-sided--; and

Line 28, "original" should read --originals--.

COLUMN 20

Line 49, "than" should read --that--.

Signed and Sealed this

Twenty-ninth Day of November, 1994

Bruce Lehman

*Attest:*

BRUCE LEHMAN

*Attesting Officer*

*Commissioner of Patents and Trademarks*